US012642405B2

(12) United States Patent
So et al.

(10) Patent No.: US 12,642,405 B2
(45) Date of Patent: Jun. 2, 2026

(54) VACUUM CLEANER AND METHOD FOR CONTROLLING THEREOF

(71) Applicant: Samsung Electronics Co., Ltd., Suwon-si (KR)

(72) Inventors: Jeayun So, Suwon-si (KR); Jinhee Kim, Suwon-si (KR); Sangsik Yoon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 410 days.

(21) Appl. No.: 18/194,928

(22) Filed: Apr. 3, 2023

(65) Prior Publication Data

US 2024/0008703 A1 Jan. 11, 2024

Related U.S. Application Data

(63) Continuation of application No. PCT/KR2023/003959, filed on Mar. 24, 2023.

(30) Foreign Application Priority Data

Jul. 11, 2022 (KR) ..... 10-2022-0085296

(51) Int. Cl.

| | |
|---|---|
| ***A47L 9/28*** | (2006.01) |
| ***A47L 9/04*** | (2006.01) |
| ***A47L 11/40*** | (2006.01) |

(52) U.S. Cl.

CPC ..... *A47L 9/2805* (2013.01); *A47L 9/0411* (2013.01); *A47L 9/2842* (2013.01); *A47L 9/2847* (2013.01);

(Continued)

(58) Field of Classification Search

CPC .... A47L 9/2805; A47L 9/2842; A47L 9/2894; A47L 9/2847; A47L 9/0411;

(Continued)

(56) References Cited

U.S. PATENT DOCUMENTS 4,706,327 A 11/1987 Getz et al.
7,856,291 B2 * 12/2010 Jung ..... G05D 1/0255 700/250

(Continued)

FOREIGN PATENT DOCUMENTS

DE 101 13 105 A1 10/2001
EP 1 136 027 B1 7/2008

(Continued)

OTHER PUBLICATIONS

Computer generated English translation of KR 102143385 B1, published Aug. 13, 2020. (Year: 2020).*

(Continued)

*Primary Examiner* — Laura C Guidotti
(74) *Attorney, Agent, or Firm* — Jefferson IP Law, LLP

(57) ABSTRACT

A vacuum cleaner is provided. The vacuum cleaner includes a main body and a front detection sensor disposed to face forward in a suction head coupled to one end of a connection pipe extending from the main body, configured to transmit a forward signal, and receive a signal reflected from an obstacle located in a forward signal area by the forward signal, so as to detect the obstacle. The front detection sensor includes a transmission unit configured to transmit a first forward signal for detecting an obstacle located in a first signal area, and a second forward signal for detecting an obstacle located in a second signal area included in the first signal area, thereby diffusing the transmitted forward signals.

16 Claims, 27 Drawing Sheets

(52) U.S. Cl.
CPC ..... *A47L 9/2894* (2013.01); *A47L 11/4011* (2013.01); *A47L 11/4069* (2013.01)

(58) Field of Classification Search
CPC .. A47L 11/4011; A47L 11/4069; G01S 17/93; G01S 17/4816; G01S 17/4814
See application file for complete search history.

(56) References Cited

U.S. PATENT DOCUMENTS

| | | | | |
|---|---|---|---|---|
| 8,127,399 | B2 | 3/2012 | Dilger et al. | |
| 8,306,662 | B2 * | 11/2012 | Kim | G01S 7/495 356/28 |
| 9,138,120 | B2 | 9/2015 | Hsu | |
| 9,629,514 | B2 | 4/2017 | Hillen et al. | |
| 9,914,219 | B2 | 3/2018 | Lee et al. | |
| 10,646,087 | B2 | 5/2020 | Kim et al. | |
| 11,147,424 | B2 | 10/2021 | So et al. | |
| 11,278,174 | B2 | 3/2022 | So et al. | |
| 11,369,245 | B2 | 6/2022 | Kim et al. | |
| 2007/0113373 | A1 | 5/2007 | Hato et al. | |
| 2007/0136981 | A1 | 6/2007 | Dilger et al. | |
| 2008/0222837 | A1 | 9/2008 | Kaffenberger et al. | |
| 2014/0373302 | A1 | 12/2014 | Hsu | |
| 2021/0267426 | A1 | 9/2021 | So et al. | |

FOREIGN PATENT DOCUMENTS

| | | | | |
|---|---|---|---|---|
| EP | 1 987 407 | B1 | 4/2013 | |
| EP | 2 636 354 | B1 | 1/2017 | |
| JP | 3115174 | B2 | 12/2000 | |
| JP | 3120442 | B2 | 12/2000 | |
| JP | 2005-216022 | A | 8/2005 | |
| JP | 2006-247229 | A | 9/2006 | |
| JP | 4680204 | B2 | 5/2011 | |
| JP | 4828445 | B2 | 11/2011 | |
| JP | 2013-149250 | A | 8/2013 | |
| JP | 5815306 | B2 | 11/2015 | |
| JP | 6174294 | B2 | 8/2017 | |
| JP | 2018-0187036 | A | 11/2018 | |
| JP | 10-2143385 | B1 | 8/2020 | |
| JP | 2021-045355 | A | 3/2021 | |
| JP | 6848798 | B2 | 3/2021 | |
| KR | 10-0728225 | B1 | 6/2007 | |
| KR | 10-2009-0119638 | A | 11/2009 | |
| KR | 10-2010-0082517 | A | 7/2010 | |
| KR | 10-2012-0042391 | A1 | 5/2012 | |
| KR | 10-2014-0011216 | A | 1/2014 | |
| KR | 10-1397103 | B1 | 5/2014 | |
| KR | 10-2014-0070287 | A | 6/2014 | |
| KR | 10-1411742 | B1 | 6/2014 | |
| KR | 10-2014-0123174 | A | 10/2014 | |
| KR | 10-2016-0107945 | A | 9/2016 | |
| KR | 10-1752190 | B1 | 6/2017 | |
| KR | 10-2017-0088012 | A | 8/2017 | |
| KR | 10-2017-0131164 | A | 11/2017 | |
| KR | 10-2018-0022169 | A | 3/2018 | |
| KR | 10-1931365 | B1 | 12/2018 | |
| KR | 10-1995424 | B1 | 7/2019 | |
| KR | 10-2019-0099150 | * | 8/2019 | F24F 3/16 |
| KR | 10-2019-0141369 | A | 12/2019 | |
| KR | 10-2143385 | B1 | 8/2020 | |
| KR | 10-2021-0082424 | A | 7/2021 | |
| WO | 2013/183955 | A1 | 12/2013 | |

OTHER PUBLICATIONS

Computer generated English translation of JP 6848798 B2, published Mar. 24, 2021. (Year: 2021).*

International Search Report and written opinion issued on Jun. 29, 2023, issued in International Patent Application No. PCT/KR2023/003959.

* cited by examiner

VACUUM CLEANER AND METHOD FOR CONTROLLING THEREOF

CROSS-REFERENCE TO RELATED APPLICATION(S)

This application is a continuation application, claiming priority under § 365(c), of an International application No. PCT/KR2023/003959, filed on Mar. 24, 2023, which is based on and claims the benefit of a Korean patent application number 10-2022-0085296, filed on Jul. 11, 2022, in the Korean Intellectual Property Office, the disclosure of which is incorporated by reference herein in its entirety.

BACKGROUND

1. Field

The disclosure relates to a vacuum cleaner provided with an obstacle detection sensor for detecting an obstacle.

2. Description of Related Art

A vacuum cleaner is an apparatus that inhales air on a surface by means of a motor to remove foreign substances such as dust, fine dust, bacteria, and mold contained in the inhaled air through a dust collection assembly or a filter member provided inside its main body, which is one of home appliances performing a function of cleaning the surface.

The vacuum cleaners may be implemented in a variety of models depending on the structure or function in application. For example, a cyclone-type vacuum cleaner is a vacuum cleaner capable of forming a rotating current of air therein and separating foreign substances from the air, by means of centrifugal force generated by rotation of the air, and it has the advantage that it can be used semi-permanently as it does not require a dust bag.

Further, a handy or stick-type vacuum cleaner is manufactured with relatively smaller size, and thus, a filter for filtering the air being sucked can be designed with relatively smaller size as well. Such a filter may include therein a filter sheet such as a non-woven fabric or a micro-filter.

The stick-type vacuum cleaners typically include a suction assembly providing suction force, a suction head inhaling foreign substances such as dust from a floor surface to be cleaned, a stick forming a space for foreign substances sucked from the suction head to travel therein, and a dust collection assembly filtering and accommodating the foreign substances sucked through the stick. A main body may be coupled to an upper end of the stick of the vacuum cleaner and the suction head may be coupled to a lower end thereof.

The above information is presented as background information only to assist with an understanding of the disclosure. No determination has been made, and no assertion is made, as to whether any of the above might be applicable as prior art with regard to the disclosure.

SUMMARY

A vacuum cleaner may be provided with an obstacle detection sensor for detecting an obstacle approaching during its cleaning. A plurality of obstacle detection sensors may be provided in a suction head to detect obstacles located in front and/or side of the vacuum cleaner without any blind spot.

Aspects of the disclosure are to address at least the above-mentioned problems and/or disadvantages and to provide at least the advantages described below. Accordingly, an aspect of the disclosure is to provide a vacuum cleaner capable of detecting existence of an obstacle or a user approaching the vacuum cleaner without any blind spot, through an obstacle detection sensor.

Additional aspects will be set forth in part in the description which follows and, in part, will be apparent from the description, or may be learned by practice of the presented embodiments.

In accordance with an aspect of the disclosure, a vacuum cleaner is provided. The vacuum cleaner includes a main body, and a front detection sensor disposed to face forward in a suction head coupled to one end of a connection pipe extending from the main body, configured to transmit a forward signal, and receive a signal reflected from an obstacle located in a forward signal area by the forward signal, so as to detect the obstacle, wherein the front detection sensor includes a transmission unit configured to transmit a first forward signal for detecting an obstacle located in a first signal area, and a second forward signal for detecting an obstacle located in a second signal area included in the first signal area, thereby diffusing the transmitted first forward signal and the second forward signal.

The transmission unit includes a light emitting unit configured to transmit the first forward signal and the second forward signal, and a diffusion unit configured to diffuse the first forward signal and the second forward signal transmitted from the light emitting unit.

The diffusion unit includes a first lens having a predetermined refractive index.

A groove for inserting the light emitting unit is provided inside the first lens.

The diffusion unit includes a first reflection plate having a predetermined reflection angle.

The front detection sensor further includes a receiving unit, and the receiving unit includes at least one receiver and a second lens configured to concentrate a signal reflected from the obstacle onto the at least one receiver.

The front detection sensor further includes a receiving unit, and the receiving unit includes at least one receiver and a second reflection plate configured to concentrate a signal reflected from the obstacle to the at least one receiver.

The front detection sensor includes a first receiver and a second receiver, and further includes a separation wall arranged to separate a signal incident on the first receiver from a signal incident on the second receiver between the first receiver and the second receiver.

The vacuum cleaner further includes a controller configured to increase a rotation speed of a suction motor or a brush motor, based on an obstacle being detected in the forward signal area, and to decrease the rotation speed of the suction motor or the brush motor, based on no obstacle being detected in the forward signal area.

The vacuum cleaner further includes a controller configured to actuate a light unit or a vibration unit, based on the obstacle being detected in the forward signal area.

The first forward signal and the second forward signal may have different patterns between a leading signal and an ending signal.

The vacuum cleaner further includes a controller configured to control the suction motor or the brush motor so that a rotation speed of the suction motor or the brush motor increases from a first rotation speed to a second rotation speed, based on an obstacle being detected in the first signal area.

The controller is further configured to control the suction motor or the brush motor so that a rotation speed of the suction motor or the brush motor increases from the second rotation speed to a third rotation speed, based on an obstacle being detected in the second signal area.

The vacuum cleaner further includes a rear detection sensor disposed to face backward in the connection pipe, configured to transmit a backward signal, and receive a signal reflected from a user located in a backward signal area by the backward signal so as to detect the user.

The vacuum cleaner further includes a controller configured to control at least one of rotation speed of a suction motor or a brush motor, based on a signal reflected from the user.

The controller is configured to control to decrease a rotation speed of at least one of the suction motor or the brush motor, based on a signal reflected from the user being detected, and increase the rotation speed of at least one of the suction motor or the brush motor, based on no signal reflected from the user being detected.

In accordance with another aspect of the disclosure, a vacuum cleaner is provided. The vacuum cleaner includes a main body, a damp floorcloth head including a pad rotating for removing foreign substances on a floor, and a pad motor configured to provide rotational force to the pad, a connection pipe connecting the main body to the damp floorcloth head, and an obstacle detection sensor configured to transmit a signal for detecting an obstacle, and detect the obstacle approaching the vacuum cleaner, based on receiving the signal reflected by the obstacle, wherein the obstacle detection sensor includes a transmission unit configured to diffuse the signal to form a signal area within a range.

The vacuum cleaner further includes a controller configured to stop operation of a water supply motor for supplying water to an injection port provided in the damp floorcloth head, based on an obstacle being detected by the obstacle detection sensor.

The vacuum cleaner further includes a controller configured to control rotation speed of a water supply motor supplying water to the pad or the pad motor, based on whether the obstacle is detected by the obstacle detection sensor.

The controller is further configured to control the rotation speed of the pad motor or the water supply motor to a first rotation speed, based on the obstacle being not detected by the obstacle detection sensor, and control the rotation speed of the pad motor and the water supply motor to a second rotation speed, based on the obstacle being detected by the obstacle detection sensor, wherein the second rotation speed may be faster than the first rotation speed.

The vacuum cleaner according to various embodiments proposed in the disclosure can establish a signal area for detecting an obstacle, using a diffusion unit for diffusing an obstacle detection signal, thereby detecting the obstacle or a user located in a front or rear area of the vacuum cleaner without any blind spot.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
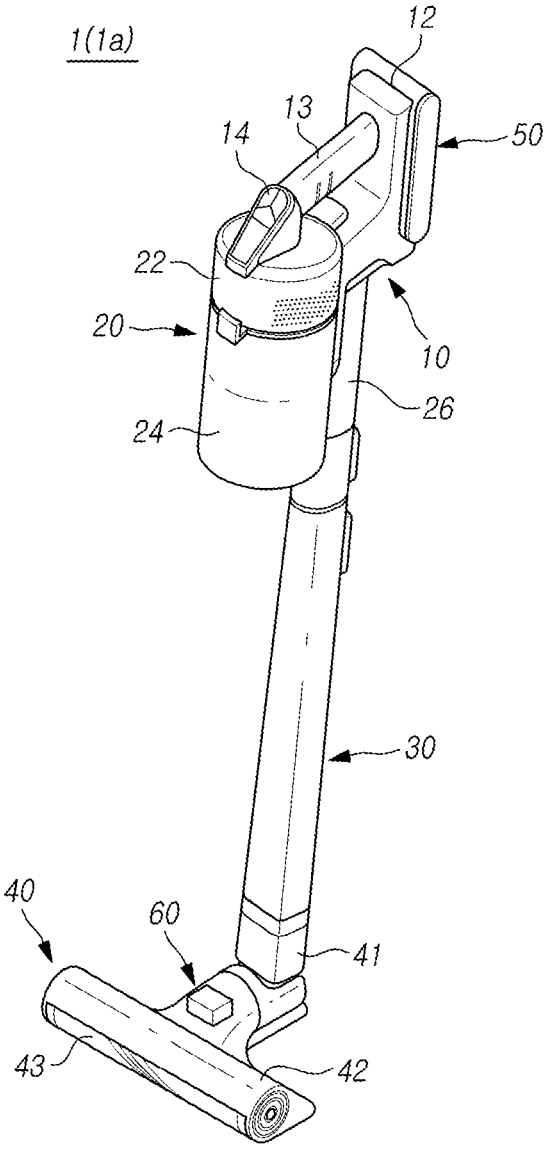
FIG. 1 is a perspective view of a vacuum cleaner according to an embodiment of the disclosure.
Figure 2A:
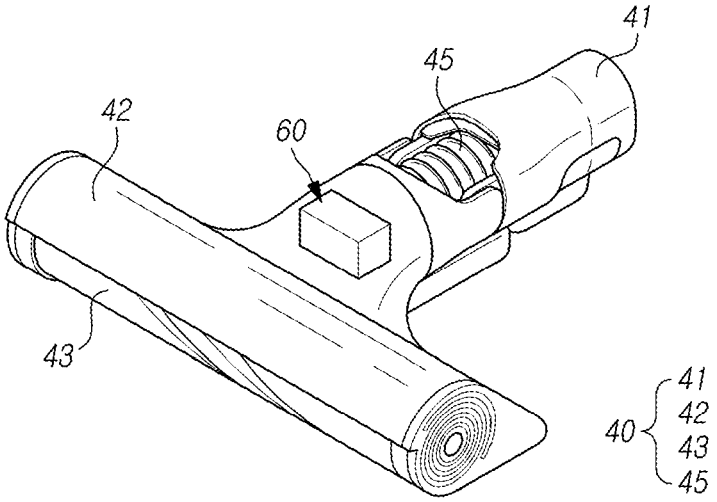
FIGS. 2A and 2B each are a perspective view of a suction head illustrated in FIG. 1 according to various embodiments of the disclosure.
Figure 2B:
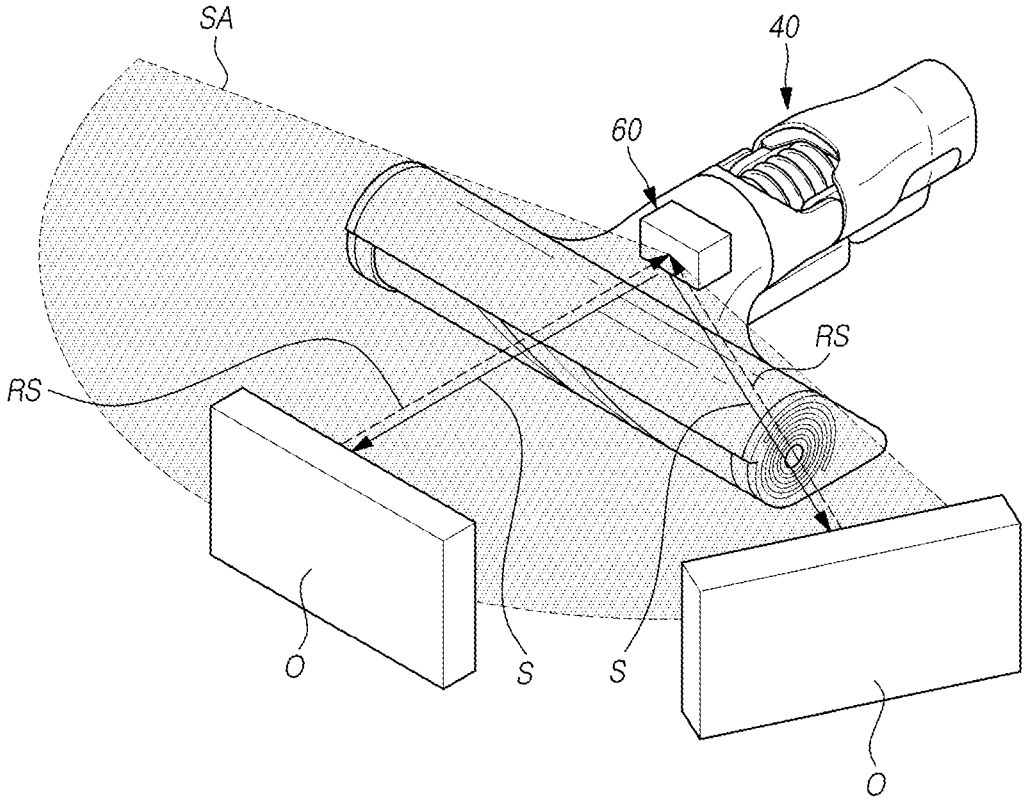

FIG. 1 is a perspective view of a vacuum cleaner according to an embodiment of the disclosure. FIGS. 2A and 2B each are a perspective view of a suction head illustrated in FIG. 1 according to various embodiments of the disclosure.

Referring to FIGS. 1, 2A, and 2B, according to an embodiment, a vacuum cleaner 1 may include a vacuum cleaner body 10, a suction assembly 20, a connection pipe 30, a suction head 40, a battery 50, or an obstacle detection sensor 60.

According to an embodiment, the vacuum cleaner body 10 may include a battery mounting portion 12, a handle 13, and a control panel 14.

According to an embodiment, the battery mounting portion 12 may be provided to mount the battery 50 onto the vacuum cleaner body 10 to be fixed thereto. The battery mounting portion 12 may be provided such that the battery 50 is mounted in a vertical direction, for example. The battery mounting portion 12 may be arranged at a rear part of the vacuum cleaner body 10.

According to an embodiment, the handle 13 may be provided so that a user can grip the vacuum cleaner 1 for its operation. The handle 13 may be positioned above the vacuum cleaner 1.

According to an embodiment, the control panel 14 may be configured to receive an operation command for the vacuum cleaner 1 from a user and provide the user with the current state of the vacuum cleaner 1. The control panel 14 may include, for example, a power button (not shown) for turning on or off the vacuum cleaner 1. The control panel 14 may include, for example, a function button (not shown) for changing an operating mode of the vacuum cleaner 1. The function button is, for example, a button for setting a desired cleaning mode of the vacuum cleaner 1, such as, e.g., normal mode, power mode, superpower mode, of which suction force can be adjusted according to the user's manipulation.

According to an embodiment, the suction assembly 20 may provide suction force to the vacuum cleaner 1 so that air and foreign substances such as dust present on a floor surface can be sucked into the vacuum cleaner 1. The suction assembly 20 may separate air and foreign substances by generating a rotating airflow (e.g., cyclone) therein. For example, when the suction assembly 20 is operating, the sucked-in foreign substances can be separated from the air by centrifugal force caused by the rotating airflow. For example, when the suction assembly 20 is operating, the sucked-in air may be separated from the foreign substance by the centrifugal force generated by the rotating airflow and then discharged to the outside. Further, the suction assembly 20 may be configured to collect the foreign substance separated from the air.

The suction assembly 20 may be coupled to the vacuum cleaner body 10 or separated from the vacuum cleaner body 10. That is, the suction assembly 20 may be provided detachably from the vacuum cleaner body 10.

The suction assembly 20 may include a suction module 22, a dust container 24, or a main body connection 26.

According to an embodiment, the suction module 22 may include a suction motor 22*a* that supplies power to the suction assembly 20.

According to an embodiment, the dust container 24 may accommodate dust introduced into the suction assembly 20 by operation of the suction module 22 and separated from the air. The dust container 24 may be detachably coupled to the suction module 22. At least part of the suction module 22 may be seated in the dust container 24. The dust container 24 may be formed of a transparent material so that the user may check the amount of dust collected in the dust container 24.

According to an embodiment, the main body connection 26 may be coupled to the vacuum cleaner body 10 and/or the connection pipe 30. One end of the main body connection 26 may be coupled to the vacuum cleaner body 10 and the other end thereof may be coupled to the connection pipe 30. The main body connection 26 may be configured to guide air and dust introduced into the vacuum cleaner 1 along the suction head 40 and the connection pipe 30 to the suction assembly 20. According to some embodiments, the main body connection 26 may be integrally formed with the connection pipe 30.

According to an embodiment, the connection pipe 30 may be coupled to the suction assembly 20 and/or the suction head 40. The connection pipe 30 may have one end coupled to the suction assembly 20 and the other end coupled to the suction head 40. When the main body connection 26 and the connection pipe 30 are integrally formed, the connection pipe 30 may be directly connected to the vacuum cleaner body 10. The connection pipe 30 may be formed in a hollow cylinder shape. The connection pipe 30 may extend in the vertical direction. The connection pipe 30 may be formed in a double-pipe shape such that the length of the connection pipe 30 be variable in the vertical direction according to the user's manipulation. The connection pipe 30 may form a flow path through which air or foreign substances sucked from the suction head 40 flow therein.

According to an embodiment, the suction head 40 comes into contact with a bottom surface when the vacuum cleaner 1 is operating, so as to suck air and dust from the bottom surface into the vacuum cleaner 1. The suction head 40 may be provided to be rotatable in an up/down (vertical) direction or a left/right (horizontal) direction. The suction head 40 may be coupled to the connection pipe 30. The suction head 40 may be detachably coupled to the connection pipe 30, for example.

The suction head 40 may include a suction head coupling 41, a brush case 42, a brush 43, a brush motor 44, or a suction head joint 45.

According to an embodiment, one end of the suction head coupling 41 may be coupled to the connection pipe 30, and the other end thereof may be coupled to the brush case 42. The suction head coupling 41 may be detachably provided in the connection pipe 30, for example.

According to an embodiment, the brush case 42 may form the overall appearance of the suction head 40. In the brush case 42 may be accommodated the brush 43 and the brush motor 44. One end of the brush case 42 may be formed with an opening so that air and dust are sucked in.

According to an embodiment, the brush 43 may be rotatably disposed in the brush case 42. The brush 43 may be disposed parallel to the bottom surface. As the brush 43 rotates, air and dust present on the bottom surface may be sucked into the vacuum cleaner 1.

According to an embodiment, the brush motor 44 may provide power to the brush 43, for rotating the brush 43. The brush motor 44 may be arranged inside the brush case 42.

According to an embodiment, the suction head joint 45 may be provided between the suction head coupling 41 and the brush case 42. The suction head 40 may rotate in either an up/down direction or a left/right direction by the suction head joint 45.

According to an embodiment, the battery 50 may supply power required for operating the vacuum cleaner 1 to the vacuum cleaner 1. The battery 50 may be arranged to be detachable from the vacuum cleaner body 10. The battery 50 may be, for example, mounted on the battery mounting portion 12 to be coupled to the vacuum cleaner body 10. The battery 50 may be, for example, implemented with at least one rechargeable secondary battery.

According to an embodiment, the obstacle detection sensor 60 may detect an obstacle located in a front and/or side of the vacuum cleaner 1 while cleaning the vacuum cleaner 1. The obstacle detection sensor 60 may establish a signal area signal area (SA) for obstacle detection. Here, the signal area SA may be formed in a fan shape or a semi-circular shape. The vacuum cleaner 1 with the obstacle detection sensor 60 disposed at the position shown in FIG. 1 may be referred to as vacuum cleaner 1*a*. The obstacle detection sensor 60 may be disposed to face the front of the vacuum cleaner 1*a*. The obstacle detection sensor 60 may be disposed in, for example, the connection pipe 30 or the suction head 40.

In case where the obstacle detection sensor 60 is arranged to face forward in the suction head 40, the obstacle detection sensor 60 may be referred to as a front detection sensor 60, and the signal area SA may be referred to as a forward signal area SA. According to an embodiment, the front detection sensor 60 may transmit an obstacle detection signal (S) (or a forward signal) and receive a signal (RS) reflected from an obstacle O located in the forward signal area (SA) by the forward signal (S).

Figure 3:
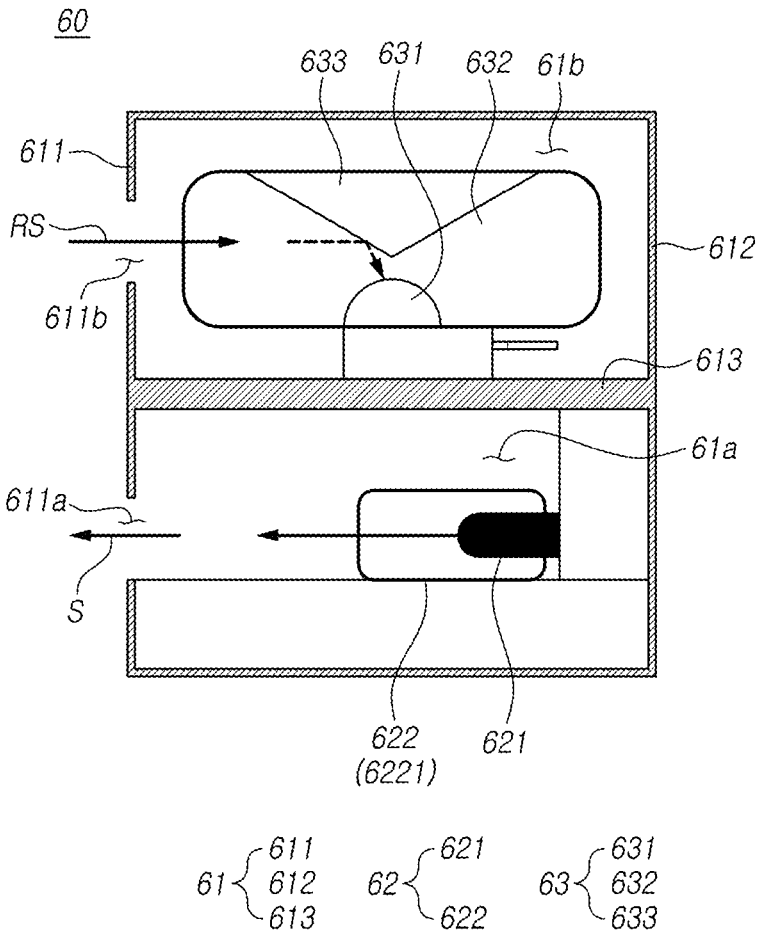
FIG. 3 is a cross-sectional view of an obstacle detection sensor according to an embodiment of the disclosure.
Figure 4:
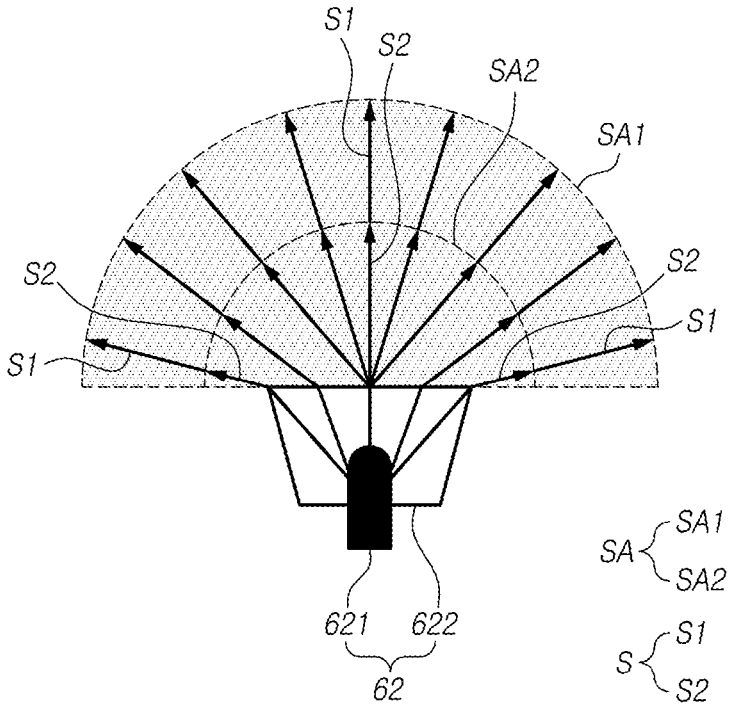
FIG. 4 is a plan view of a transmission unit illustrated in FIG. 3 according to an embodiment of the disclosure.
Figure 5:
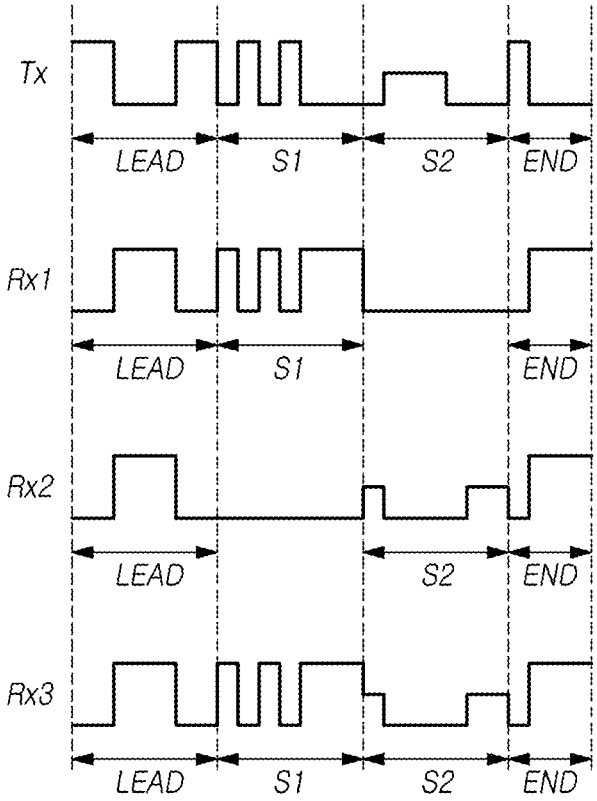
FIG. 5 is a diagram illustrating waveforms of a signal transmitted from an obstacle detection sensor and its received signal according to an embodiment of the disclosure.
Figure 6A:
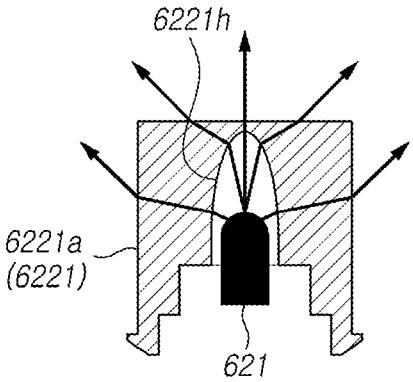
FIGS. 6A, 6B, and 6C are diagrams illustrating various embodiments of a transmission unit illustrated in FIG. 3 according to an embodiment of the disclosure.
Figure 6B:
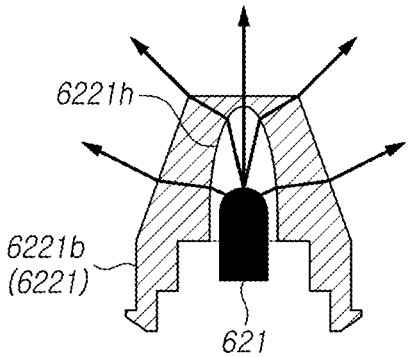
Figure 6C:
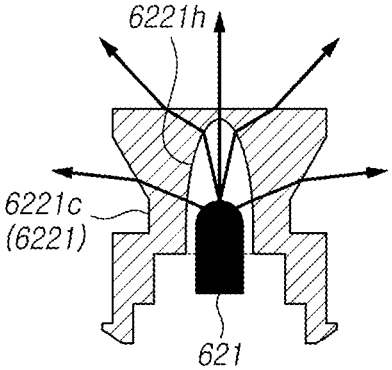

FIG. 3 is a cross-sectional view of an obstacle detection sensor according to an embodiment of the disclosure. FIG. 4 is a plan view of a transmission unit illustrated in FIG. 3 according to an embodiment of the disclosure. FIG. 5 is a diagram illustrating waveforms of a signal transmitted from the obstacle detection sensor and its received signal according to an embodiment of the disclosure. FIGS. 6A, 6B, and 6C are diagrams illustrating various embodiments of a transmission unit illustrated in FIG. 3 according to an embodiment of the disclosure.

Referring to FIGS. 3 to 5, according to an embodiment, the obstacle detection sensor 60 may include a housing 61, a transmission unit 62, or a receiving unit 63.

According to an embodiment, the housing 61 may form the overall appearance of the obstacle detection sensor 60. The housing 61 may be formed, for example, in a rectangular parallelepiped shape.

A transmission area 61*a* in which a signal for detecting an obstacle is transmitted and a reception area 61*b* in which the signal for detecting an obstacle is received may be formed Inside the housing 61.

According to an embodiment, on a front surface 611 of the housing 61 may be formed a first opening 611*a* through which the signal S transmitted from the transmission unit 62 travels. According to an embodiment, a second opening 611*b* through which the signal RS reflected from the obstacle passes may be formed on the front surface 611 of the housing 61. The first opening 611*a* may be located below the second opening 611*b*, for example.

According to an embodiment, a partition plate 613 for dividing the transmission area 61*a* and the reception area 61*b* may be provided inside the housing 61. The partition plate 613 may be positioned in between the front surface 611 of the housing 61 and a rear surface 612 of the housing 61. The partition plate 613 may connect the front surface 611 of the housing 61 and the rear surface 612 of the housing 61. With respect to the partition plate 613, the transmission area 61*a* may be formed at a lower side of the partition plate 613, and the reception area 61*b* may be formed at an upper side of the partition plate 613. However, the arrangement of the transmission area 61*a* and the reception area 61*b* is not limited thereto.

According to an embodiment, the transmission unit 62 may generate the signal S for detecting an obstacle and transmit the signal S toward the obstacle. According to an embodiment, the transmission unit 62 may transmit a first signal S1 and a second signal S2 having different patterns between its leading signal and its ending signal (see Tx in FIG. 5). According to an embodiment, the first signal S1 and the second signal S2 may have different amplitudes, and the amplitude of the first signal S1 may be implemented to be greater than the amplitude of the second signal S2. The signal S may be, for example, generated with pulse width modulation (PWM).

The transmission unit 62 may alternately generate or transmit the first signal S1 or the second signal S2 by adjusting intensity of its current, for example. The first signal S1 may detect an obstacle located farther away than the second signal S2. The first signal S1 may form a wider signal area SA1 compared to the second signal S2. The first signal area SA1 may include a second signal area SA2. The first signal area SA1 and the second signal area SA2 may be formed, for example, in a fan shape or a semi-circular shape. The first signal area SA1 and the second signal area SA2 may form a signal area SA for obstacle detection.

The transmission unit 62 may be accommodated in the housing 61. The transmission unit 62 may be disposed in the transmission area 61*a* of the housing 61, for example.

The transmission unit 62 may include a light emitting unit 621 or a diffusion unit 622.

According to an embodiment, the light emitting unit 621 may include at least one light emitting diode (LED). The light emitting unit 621 may transmit an infrared-based signal (e.g., light) having strong linearity. The light emitting unit 621 may transmit, for example, a signal of a specific frequency (e.g., 38 kHz). The light emitting unit 621 may be disposed side by side on a bottom surface of the transmission area 61*a* to face the first opening 611*a*, for example.

According to an embodiment, the diffusion unit 622 may diffuse a signal transmitted from the light emitting unit 621. The transmission unit 62 makes it possible to minimize a blind spot of signal that may be generated depending on a signal transmission angle by the diffusion unit 622. According to an embodiment, the diffusion unit 622 may have a first lens 6221 having a predetermined refractive index and refracting a signal incident from the light emitting unit 621. The transmission unit 62 may be configured to, for example, diffuse the signal transmitted from the light emitting unit 621 through the first lens 6221, and thus, establish a signal area SA for obstacle detection.

According to an embodiment, the receiving unit 63 may receive a signal RS transmitted from the transmission unit 62 and reflected onto an obstacle. According to an embodiment, the receiving unit 63 may demodulate the received signal RS. According to an embodiment, the receiving unit 63 may receive a first signal S1 (e.g., Rx1 in FIG. 5) transmitted from the transmission unit 62 and reflected by an obstacle located in the first signal area SAL. According to an embodiment, the receiving unit 63 may receive a second signal S2 (e.g., Rx2 in FIG. 5) transmitted from the transmission unit 62 and reflected from an obstacle located in the second signal area SA2. According to an embodiment, the receiving unit 63 may receive the first signal S1 and the second signal S2 transmitted from the transmission unit 62 and reflected from an obstacle located in the second signal area SA2 (e.g., Rx3 in FIG. 5).

The receiving unit 63 may be accommodated in the housing 61. The receiving unit 63 may be disposed in the reception area 61*b*, for example.

The receiving unit 63 may include at least one receiver 631. The receiving unit 63 may include at least one of a second lens 632 or a second reflection plate 633.

According to an embodiment, the receiver 631 may receive the signal RS reflected from the obstacle, demodulate the received signal, and transmit it to the controller 100. The receiving unit 63 may include one or more receivers 631. The receiver 631 may receive an infrared-based signal (e.g., light). The receiver 631 may be disposed on an upper surface of the partition plate 613, for example. The receiver 631 may be coupled to a lower end of the second lens 632, for example.

According to an embodiment, the second lens 632 has a predetermined refractive index and may focus the signal RS reflected from the obstacle on the receiver 631.

According to an embodiment, the second reflection plate 633 may be disposed above the receiver 631. The second reflection plate 633 may be formed, for example, in a conical shape. The second reflection plate 633 may reflect a signal incident on the second lens 632 and concentrate the signal toward the receiver 631.

Referring to FIGS. 6A, 6B, and 6C, according to an embodiment, a groove 6221*h* for inserting the light emitting unit 621 may be provided inside the first lens 6221. For example, the light emitting unit 621 may be seated in the groove 6221*h*. The groove 6221*h* can primarily diffuse the signal transmitted from the light emitting unit 621. The groove 6621*h* may be formed in a shape corresponding to the light emitting unit 621. The groove 6221*h* may be formed, for example, such that a cross-section of an inner surface of the first lens 6221 has an inverted parabolic shape, when the first lens 6221 is cut in a direction parallel to a traveling direction of the signal. The signal that has been primarily diffused through the groove 6221*h* may be secondarily diffused from an outer surface of the first lens 6221 and transmitted to the outside.

The first lens 6221 may be implemented in various shapes. For example, the first lens 6221*a* may be formed to have a rectangular cross-section as a whole, when the first lens 6221*a* is cut in a direction parallel to the travelling direction the signal (see FIG. 6A). As another example, the first lens 6221*b* may be formed to have a trapezoidal cross-section as a whole, when the first lens 6221*b* is cut in a direction parallel to the travelling direction of the signal (see FIG. 6B). As another example, the first lens 6221*c* may be formed to have an inverted trapezoidal cross-section, when the first lens 6221*c* is cut in a direction parallel to the travelling direction of the signal (see FIG. 6C).

Hereinafter, an obstacle detection sensor to be described later may be substantially the same as or similar to the obstacle detection sensor according to the aforementioned preceding embodiment (see FIG. 3).

Hereinafter, for convenience of explanation, description will be made of only a configuration that differs from the preceding embodiment, and the description of the configuration that is substantially the same as or similar to the preceding embodiment may be omitted.

Figure 7:
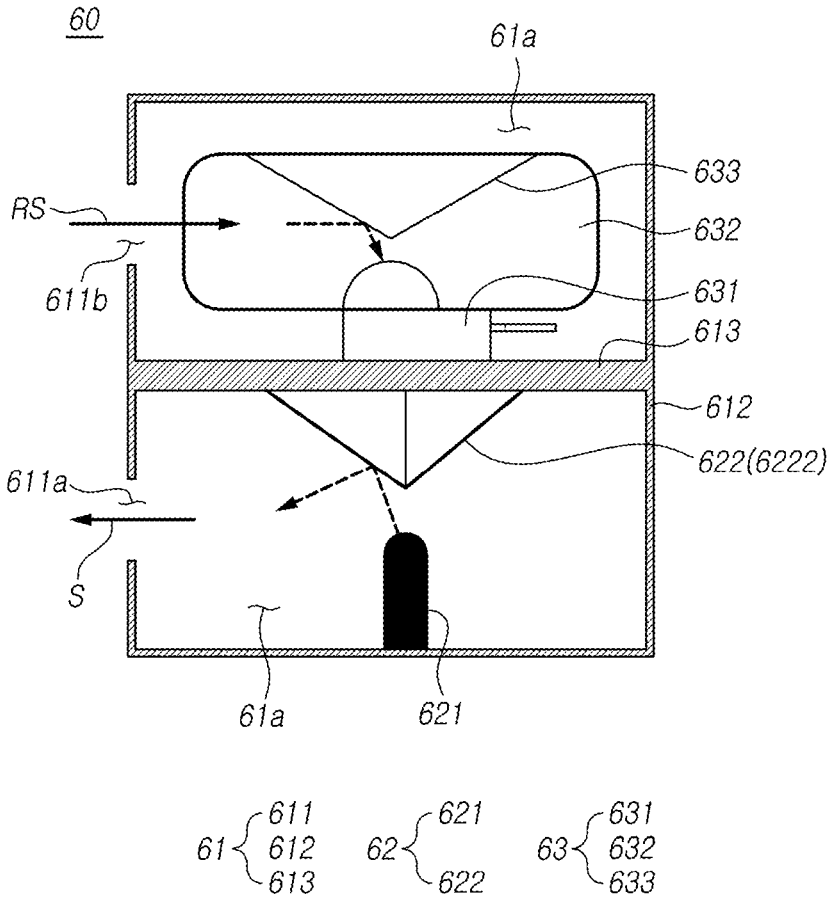
FIG. 7 is a cross-sectional view of an obstacle detection sensor according to an embodiment of the disclosure.

FIG. 7 is a cross-sectional view of an obstacle detection sensor according to an embodiment of the disclosure.

Referring to FIG. 7, according to an embodiment, the light emitting unit 621 may be disposed on a bottom surface of the transmission area 61*a*. The light emitting unit 621 may be disposed, for example, perpendicular to the bottom surface of the transmission area 61*a* to face the diffusion unit 622.

According to an embodiment, the diffusion unit 622 may include a first reflection plate 6222. The first reflection plate 6222 may have a predetermined reflective angle. The first reflection plate 6222 may be provided such that the signal transmitted from the light emitting unit 621 is reflected from the surface of the first reflection plate 6222 and transmitted to the outside. The first reflection plate 6222 may be formed, for example, in a conical shape. The first reflection plate 6222 may be disposed on a ceiling surface (e.g., a back surface of the partition plate 613) of the transmission area 61*a*.

Figure 8:
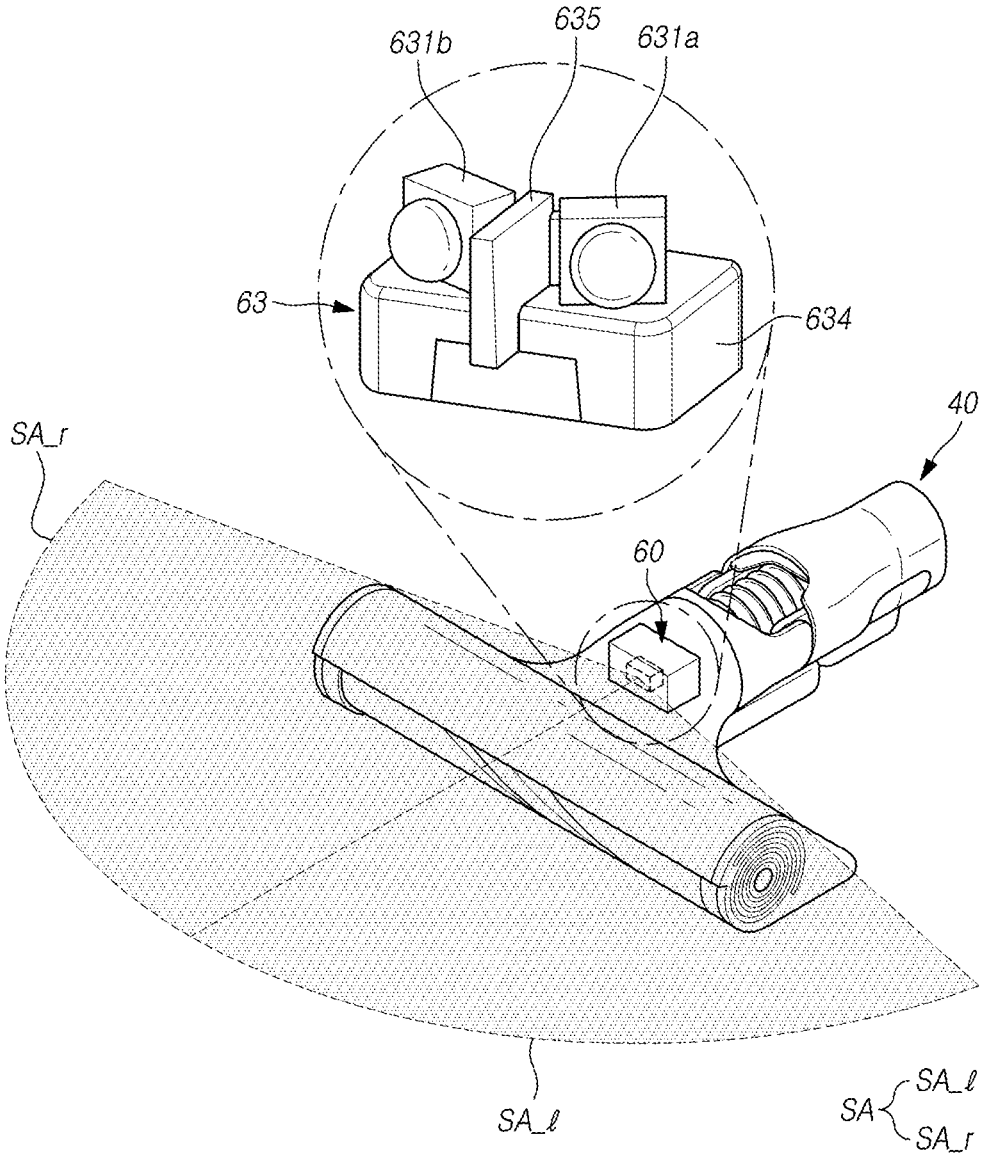
FIG. 8 is a perspective view of a suction head in which a receiving unit is enlarged according to an embodiment of the disclosure.

FIG. 8 is a perspective view of a suction head in which a receiving unit is enlarged according to an embodiment of the disclosure.

Referring to FIG. 8, according to an embodiment, the receiving unit 63 of the obstacle detection sensor 60 may include a first receiver 631*a*, a second receiver 631*b*, a receiving unit body 634, or a separation wall 635.

According to an embodiment, the receiving unit body 634 may be arranged to support the first receiver 631*a*, the second receiver 631*b*, or the separation wall 635.

According to an embodiment, the separation wall 635 may be disposed on an upper surface of the receiving unit body 634. The separation wall 635 may serve to separate the signal received by the receiving unit 63 to the left or the right. The separation wall 635 can separate, for example, a signal incident onto the first receiver 631*a* and a signal incident onto the second receiver 631*b* in between the first receiver 631*a* and the second receiver 631*b*.

According to an embodiment, the first receiver 631*a* may be disposed on the upper surface of the receiving unit body 634. The first receiver 631*a* may be disposed on one side (e.g., the left side) of the receiving unit body 634 with respect to the separation wall 635. The first receiver 631*a* may receive a left-sided signal amongst the signals received by the obstacle detection sensor 60. The first receiver 631*a* may detect, for example, the left signal area SA_1.

According to an embodiment, the second receiver 631*b* may be disposed on the upper surface of the receiving unit body 634. The second receiver 631*b* may be disposed on the other side (e.g., the right side) of the receiving unit body 634 with respect to the separation wall 635. The second receiver 631*b* may receive a right-sided signal amongst the signals received by the obstacle detection sensor 60. The second receiver 631*b* may detect, for example, the right signal area SA_r.

According to an embodiment, the vacuum cleaner 1 can distinguish a position of an obstacle that may exist in front of the vacuum cleaner 1 through the first receiver 631*a* or the second receiver 631*b*. For example, when a signal is received only by the first receiver 631*a*, the vacuum cleaner 1 may determine that the obstacle exists in a left forward position of the vacuum cleaner 1. As another example, when a signal is received only by the second receiver 631*b*, the vacuum cleaner 1 may determine that the obstacle exists in a right forward position of the vacuum cleaner 1. The vacuum cleaner 1 may determine that an obstacle exists in a forward position facing the vacuum cleaner 1, in case where the signals are received by both the first receiver 631*a* and the second receiver 631*b*, for example.

According to an embodiment, the vacuum cleaner 1 may include one receiver and two light emitting units (e.g., a first light emitting unit (not shown) and a second light emitting unit (not shown)). In such a case, the vacuum cleaner 1 may transmit the signal in the front direction of the vacuum cleaner 1 through at least one light emitting unit, so that it can detect presence of an obstacle in front of the vacuum cleaner as well as identify a position of the detected obstacle.

Figure 9:
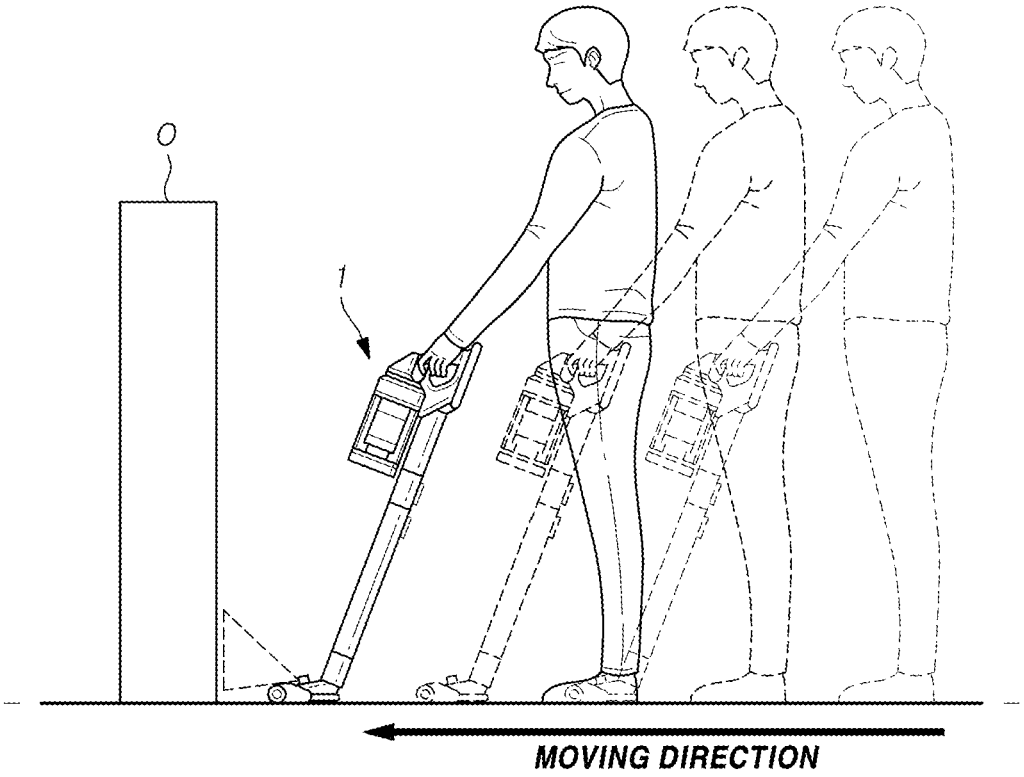
FIG. 9 is a view illustrating a situation in which a vacuum cleaner detects an obstacle, while a vacuum cleaner is cleaning forward, according to an embodiment of the disclosure.
Figure 10A:
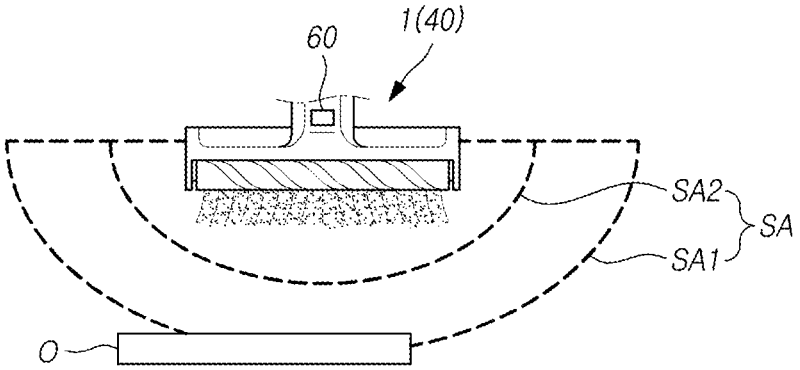
FIGS. 10A and 10B are views illustrating a situation in which an obstacle is detected in a first signal area during forward cleaning of a vacuum cleaner according to an embodiment of the disclosure.
Figure 10B:
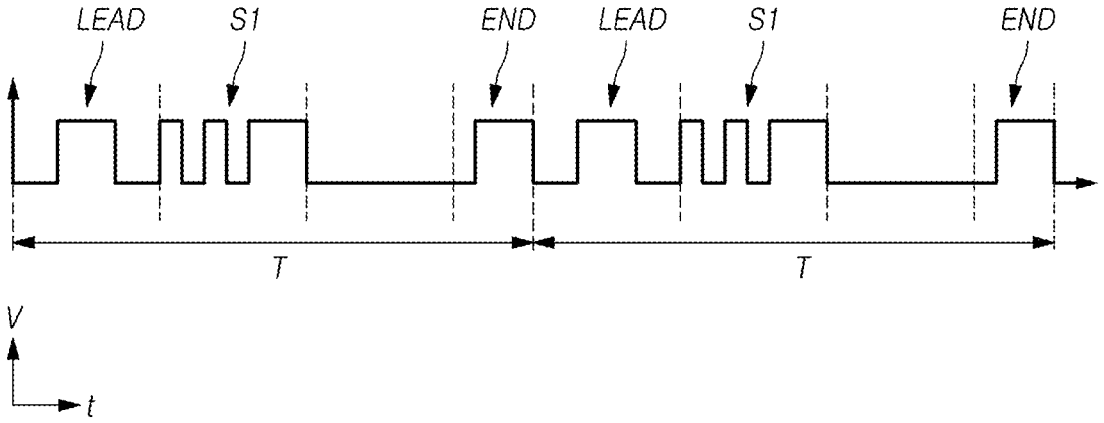
Figure 11A:
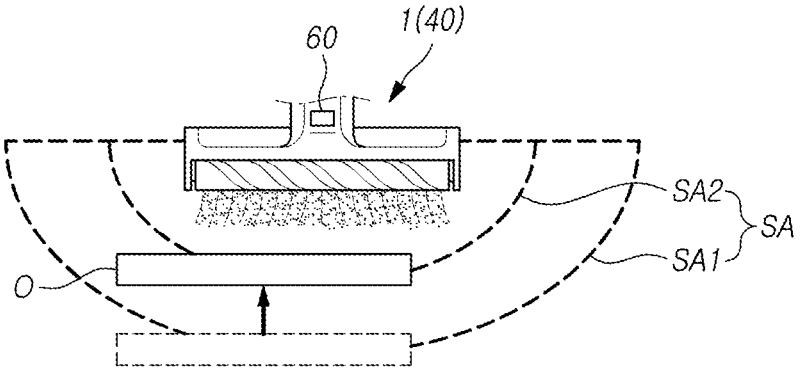
FIGS. 11A and 11B are views illustrating a situation in which an obstacle is detected in a second signal area during forward cleaning of a vacuum cleaner according to an embodiment of the disclosure.
Figure 11B:
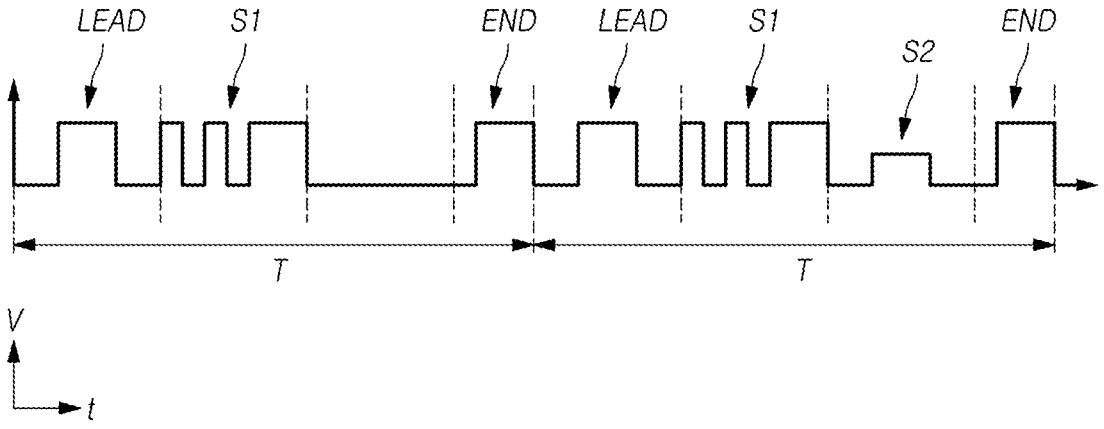
Figure 12:
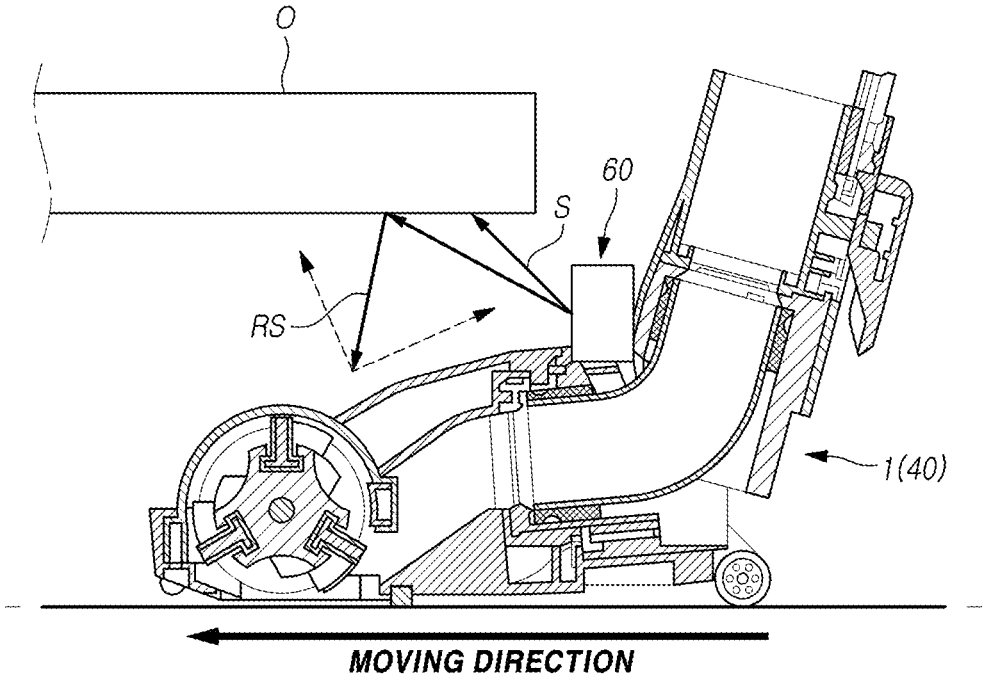
FIG. 12 is a diagram illustrating a situation in which a vacuum cleaner detects an obstacle, when a vacuum cleaner is cleaning in a confined space such as e.g., under a bed or a couch according to an embodiment of the disclosure.

FIG. 9 is a view illustrating a situation in which a vacuum cleaner detects an obstacle when a vacuum cleaner is cleaning forward, according to an embodiment of the disclosure. FIGS. 10A and 10B are views illustrating a situation in which an obstacle is detected in a first signal area during a forward cleaning of a vacuum cleaner according to an embodiment of the disclosure. FIGS. 11A and 11B are views illustrating a situation in which an obstacle is detected in a second signal area during a forward cleaning of a vacuum cleaner according to an embodiment of the disclosure. FIG. 12 is a diagram illustrating a situation in which a vacuum cleaner detects an obstacle, when a vacuum cleaner is cleaning in a confined space such as e.g., under a bed or a couch according to an embodiment of the disclosure.

Referring to FIG. 9, according to an embodiment, the vacuum cleaner 1 may detect presence of an obstacle O existing on the signal area SA established by the obstacle detection sensor 60 while cleaning forward by a user's manipulation.

Referring to FIGS. 10A and 10B, according to an embodiment, the obstacle O can be detected on the first signal area SA1, as the vacuum cleaner 1 approaches the obstacle O during cleaning of the vacuum cleaner 1. For example, if a first signal S1 transmitted from the obstacle detection sensor 60 is reflected by the obstacle O and then received again by the obstacle detection sensor 60, the vacuum cleaner 1 may determine that the obstacle O exists in the first signal area SAL. In other words, the vacuum cleaner 1 may determine a current cleaning state of the vacuum cleaner 1 as approaching the obstacle O.

Referring to FIGS. 11A and 11B, according to an embodiment, the obstacle O may be detected within the second signal area SA2 as the vacuum cleaner 1 continues to approach the obstacle O during cleaning of the vacuum cleaner 1. For example, when the first signal S1 and/or the second signal S2 transmitted from the obstacle detection sensor 60 is reflected by the obstacle O and then received by the obstacle detection sensor 60, the vacuum cleaner 1 may determine that the obstacle O exists in the second signal area SA2. For example, the vacuum cleaner 1 may determine that an obstacle O exists in the second signal area SA2 if only the second signal S2 is received by the obstacle detection sensor 60 or both the first signal S1 and the second signal S2 are received by the obstacle detection sensor 60. In other words, the vacuum cleaner 1 may determine its current operating state that it may collide with the obstacle O if it keeps traveling forward.

Referring to FIG. 12, according to an embodiment, when the suction head 40 of the vacuum cleaner 1 passes through a lowermost side of the obstacle O such as e.g., under a bed or a couch, the vacuum cleaner 1 may determine that the obstacle O exists above the suction head 40, using diffused reflection of the obstacle detection signal S transmitted from the obstacle detection sensor 60. When it is determined that an obstacle O is present above the suction head 40, the vacuum cleaner 1 may control a light unit 80, a suction motor 22*a*, or a brush motor 44. The vacuum cleaner 1 may, for example, actuate the light unit 80 to light up the lower space of the darkened obstacle O. The vacuum cleaner 1 may increase, for example, the rotation speed (e.g., rotations per minute (RPM)) of the suction motor 22*a* or the brush motor 44.

Figure 13:
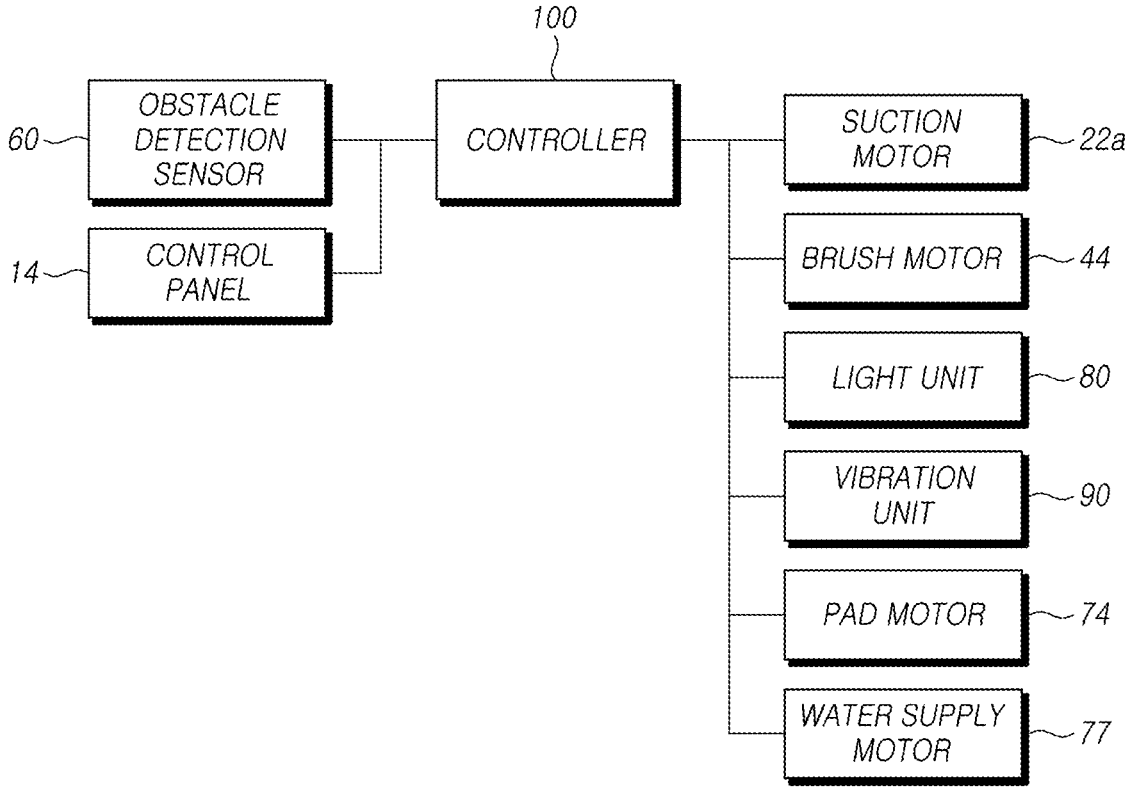
FIG. 13 is a block diagram of an example configuration of a vacuum cleaner according to an embodiment of the disclosure.

FIG. 13 is a block diagram of a configuration for controlling of a vacuum cleaner 1 according to an embodiment of the disclosure.

Referring to FIG. 13, according to various embodiments, the vacuum cleaner 1 may include a controller 100 for controlling the overall operation of the vacuum cleaner 1. The controller 100 may be configured to set or change one of the cleaning modes (e.g., a normal mode, a power mode, or a superpower mode) of the vacuum cleaner 1, in response to the user's instructions input to the control panel 14. According to an embodiment, the controller 100 may control the operation of the suction motor 22*a* and/or the brush motor 44 according to whether an obstacle is detected through the obstacle detection sensor 60. For example, when the obstacle is detected by the obstacle detection sensor 60, the controller 100 may control the rotation speed (e.g., RPM) of the suction motor 22*a* and/or the rotation speed (e.g., RPM) of the brush motor 44.

According to an embodiment, the vacuum cleaner 1 may further include a light unit 80 that irradiates light toward a front or bottom surface of the vacuum cleaner 1 so that the user can visually check any foreign substances present on the floor surface. The light unit 80 may be disposed in the suction head 40 or the connection pipe 30. According to an embodiment, when an obstacle is detected by the obstacle detection sensor 60, the controller 100 may turn the light unit 80 on.

According to an embodiment, the vacuum cleaner 1 may further include a vibration unit 90 that generates vibration in the vacuum cleaner 1. The vibration unit 90 may be disposed on the handle 13 of the vacuum cleaner body 10. According to an embodiment, when an obstacle is detected by the obstacle detection sensor 60, the controller 100 may transmit vibration corresponding to the received signal area (e.g., the first signal area SA1 or the second signal area SA2) to the user. For example, the vibration corresponding to the second signal area SA2 may be stronger than the vibration corresponding to the first signal area SA1. Consequently, the vacuum cleaner 1 can perform a vibration notification function to inform the user that the vacuum cleaner 1 is quite close to the obstacle and that the vacuum cleaner 1 may hit the obstacle, by means of the vibration.

Figure 14:
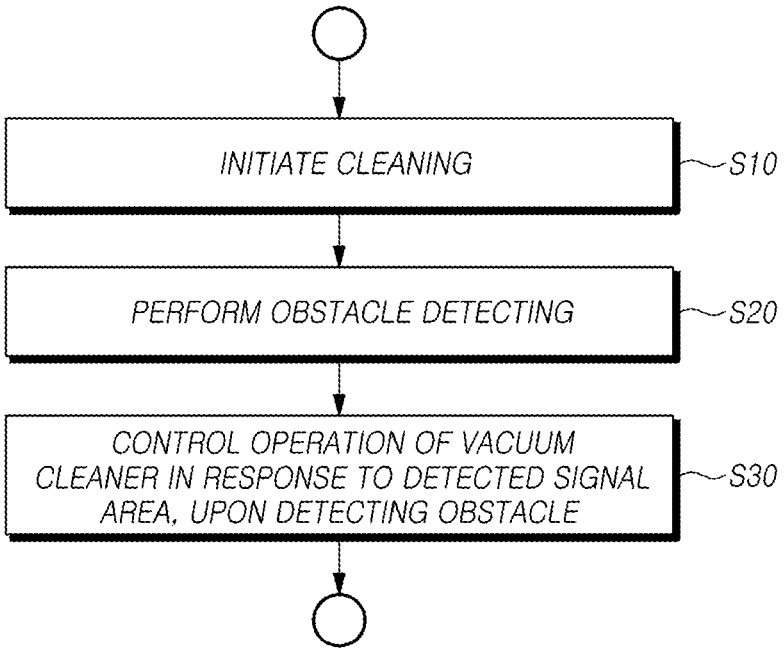
FIG. 14 is a flowchart illustrating a method of controlling a vacuum cleaner according to an embodiment of the disclosure.
Figure 15:
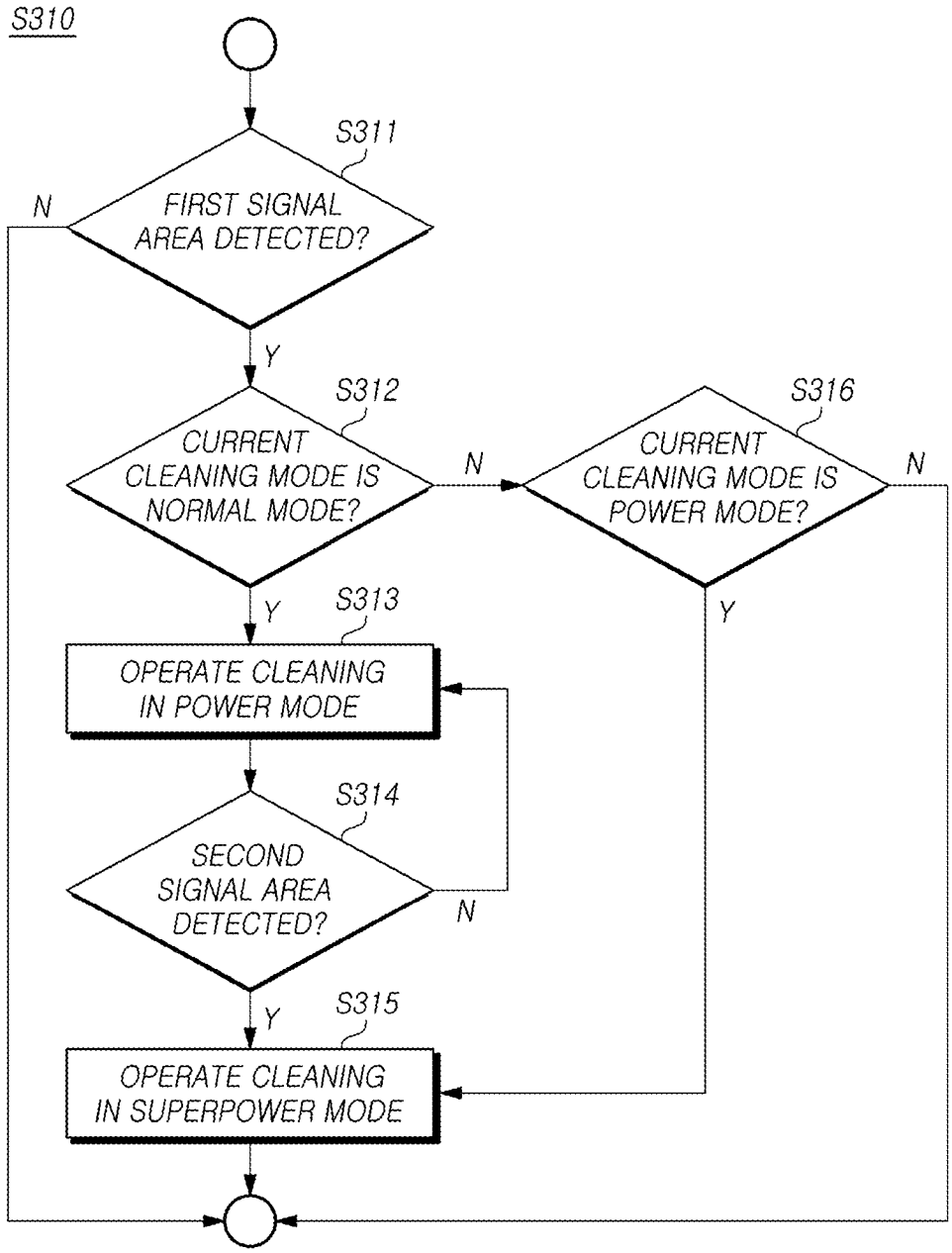
FIG. 15 is a flowchart of an example control method 8310 of a vacuum cleaner according to an embodiment of the disclosure.
Figure 16:
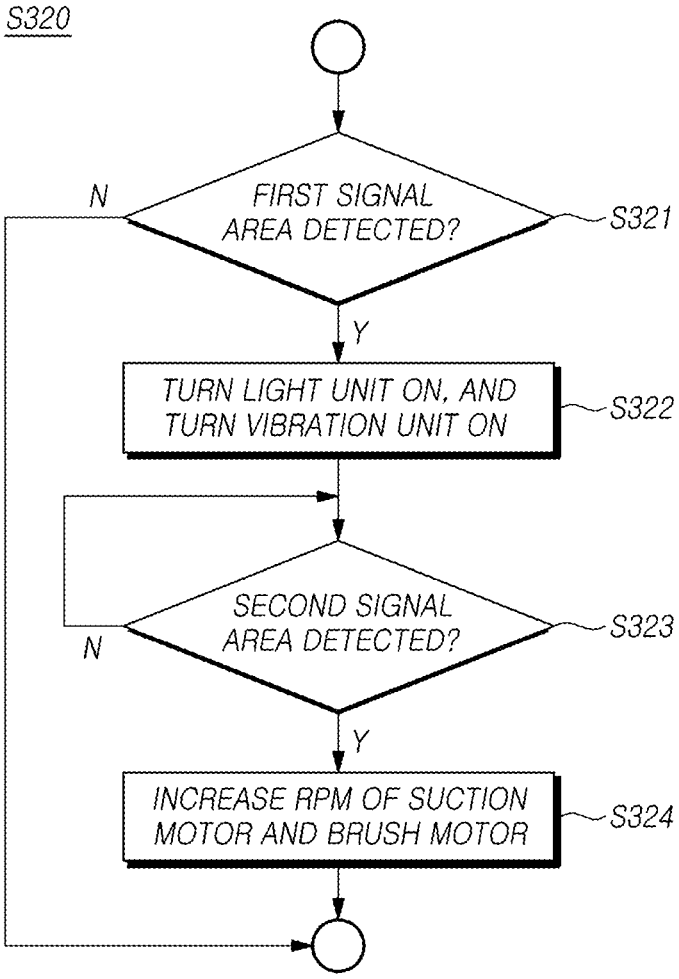
FIG. 16 is a flowchart of an example control method 8320 of a vacuum cleaner according to an embodiment of the disclosure.

FIG. 14 is a flowchart illustrating a method of controlling a vacuum cleaner according to an embodiment of the disclosure. FIG. 15 is a flowchart illustrating an example control method S310 of a vacuum cleaner according to an embodiment of the disclosure. FIG. 16 is a flowchart illustrating an example control method S320 of a vacuum cleaner according to an embodiment of the disclosure.

Referring to FIG. 14, according to an embodiment, the vacuum cleaner 1 may initiate at operation S10 and/or maintain a cleaning operation for removing foreign substances present on the floor surface by a user's command and/or manipulation. For example, the vacuum cleaner 1 may operate a pad motor 74 and/or a water supply motor 77 according to the user's command and/or manipulation.

According to an embodiment, the vacuum cleaner 1 may perform at operation S20 a function of detecting an obstacle close to the vacuum cleaner 1, by means of the obstacle detection sensor 60 during a cleaning operation.

According to an embodiment, when an obstacle is detected through the obstacle detection sensor 60, the vacuum cleaner 1 may control at operation S30 the operation of the vacuum cleaner 1 in response to the detected signal area (e.g., the first signal area SA1 or the second signal area SA2). For example, when an obstacle is detected through the obstacle detection sensor 60, the vacuum cleaner 1 can control the operation of at least one of the light unit 80, the vibration unit 90, the suction motor 22*a*, or the brush motor 44, in response to the detected signal area (e.g., the first signal area SA1 or the second signal area SA2) of the obstacle.

Referring to FIG. 15, according to an embodiment, in operation S30, the vacuum cleaner 1 may control (S310) its operation mode differently depending upon the signal area of the obstacle detected through the obstacle detection sensor 60. For example, the vacuum cleaner 1 may control the operation of the suction motor 22*a* or the brush motor 44 according to the operation mode corresponding to each signal area.

According to an embodiment, the vacuum cleaner 1 may determine at operation S311 whether the obstacle is close to the first signal area SA1 through the obstacle detection sensor 60.

According to an embodiment, if the obstacle is close to the first signal area SA1 (Yes in operation S311), the vacuum cleaner 1 may determine whether the current cleaning mode is a normal mode at operation S312.

According to an embodiment, when the current cleaning mode is a normal mode (Yes in operation S312), the vacuum cleaner 1 may change the cleaning mode from the normal mode to the power mode at operation S313. Here, the power mode may refer to a cleaning mode that the rotation speed (e.g., RPM) of the suction motor 22*a* and/or the brush motor 44 is higher than the rotation speed of the suction motor 22*a* and/or the brush motor 44 in the normal mode, compared to the normal mode. For example, in the normal mode, the suction motor 22*a* and/or the brush motor 44 may rotate at a first rotation speed. For example, in the power mode, the suction motor 22*a* and/or the brush motor 44 may rotate at a second rotation speed faster than the first rotation speed.

According to an embodiment, the vacuum cleaner 1 may determine at operation S314 whether the obstacle is close to the second signal area SA2 through the obstacle detection sensor 60, while maintaining the cleaning mode changed from the normal mode to the power mode.

According to an embodiment, when the obstacle is closer to the second signal area SA2 (Yes in operation S314), the vacuum cleaner 1 may control to change the cleaning mode from the power mode to a superpower mode at operation S315. Here, the superpower mode may refer to a cleaning mode in which the rotation speed (e.g., RPM) of the suction motor 22*a* and/or the brush motor 44 is higher than the rotation speed of the suction motor 22*a* and/or the brush motor 44 in the power mode, compared to the power mode. For example, in the superpower mode, the suction motor 22*a* and/or the brush motor 44 may rotate at a third rotation speed faster than the second rotation speed.

Looking at operation S312 again, when the current cleaning mode is not in a normal mode (No in operation S312), the vacuum cleaner 1 may determine whether the current cleaning mode is in the power mode at operation S316.

According to an embodiment, when the current cleaning mode is in the power mode (Yes in operation S316), the vacuum cleaner 1 may change the cleaning mode from the power mode to the superpower mode at operation S315.

According to an embodiment, when the current cleaning mode is not currently in the power mode (No in operation S316), the vacuum cleaner 1 may determine that the current cleaning mode is the superpower mode and maintain the current cleaning mode in the superpower mode.

Referring to FIG. 16, according to an embodiment, when an obstacle is detected through the obstacle detection sensor 60 in operation S30, the vacuum cleaner 1 may control the operation of the light unit 80, the vibration unit 90, the suction motor 22*a*, or the brush motor 44 (S320).

According to an embodiment, the vacuum cleaner 1 may determine whether the obstacle is close to the first signal area SA1 through the obstacle detection sensor 60 at operation S321.

According to an embodiment, if the obstacle gets close to the first signal area SA1 (Yes in operation S321), the vacuum cleaner 1 may control to turn on the light unit 80 so that light is irradiated to the front or bottom surface of the vacuum cleaner 1 at operation S322. According to an embodiment, if the obstacle approached the first signal area SA1 (Yes in operation S321), the vacuum cleaner 1 can actuate the vibration unit 90 to transmit vibration to the user at operation S322.

According to an embodiment, the vacuum cleaner 1 may maintain the current cleaning mode and determine whether the obstacle has approached the second signal area SA2 at operation S323.

According to an embodiment, the vacuum cleaner 1 may control to increase the rotation speed (e.g., RPM) of the suction motor 22*a* and/or the brush motor 44 if the obstacle has approached the second signal area SA2 at operation S324.

Figure 17:
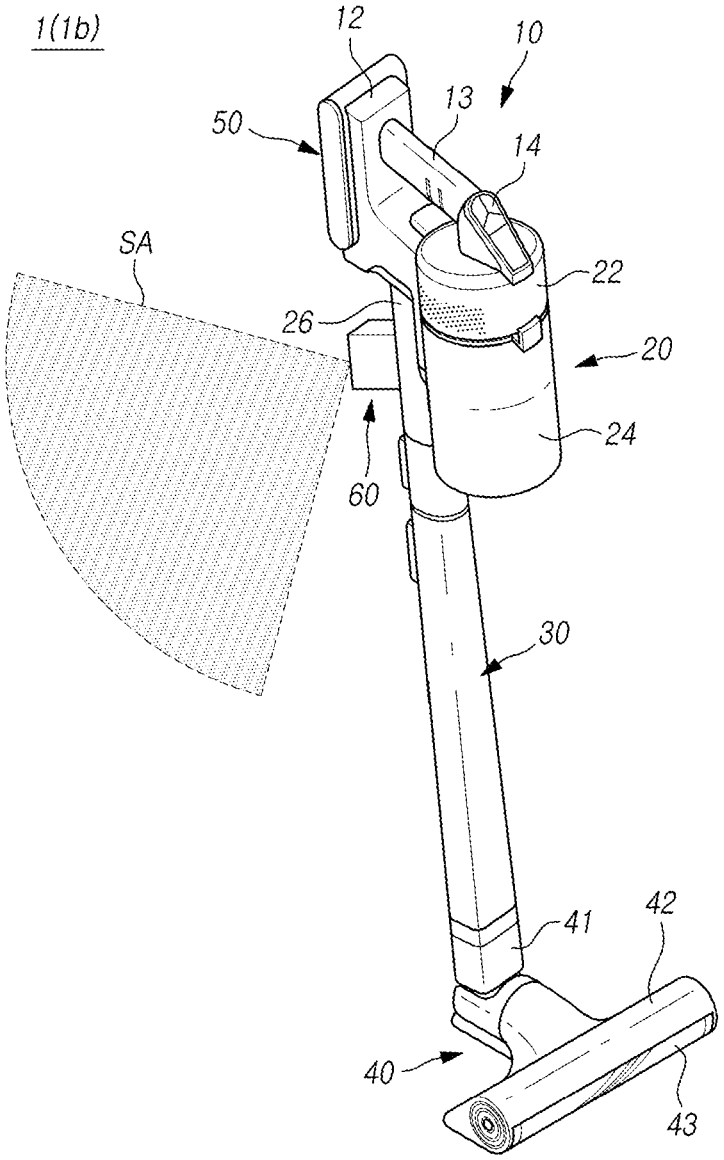
FIG. 17 is a perspective view of a vacuum cleaner with an obstacle detection sensor arranged at the rear, according to an embodiment of the disclosure.
Figure 18:
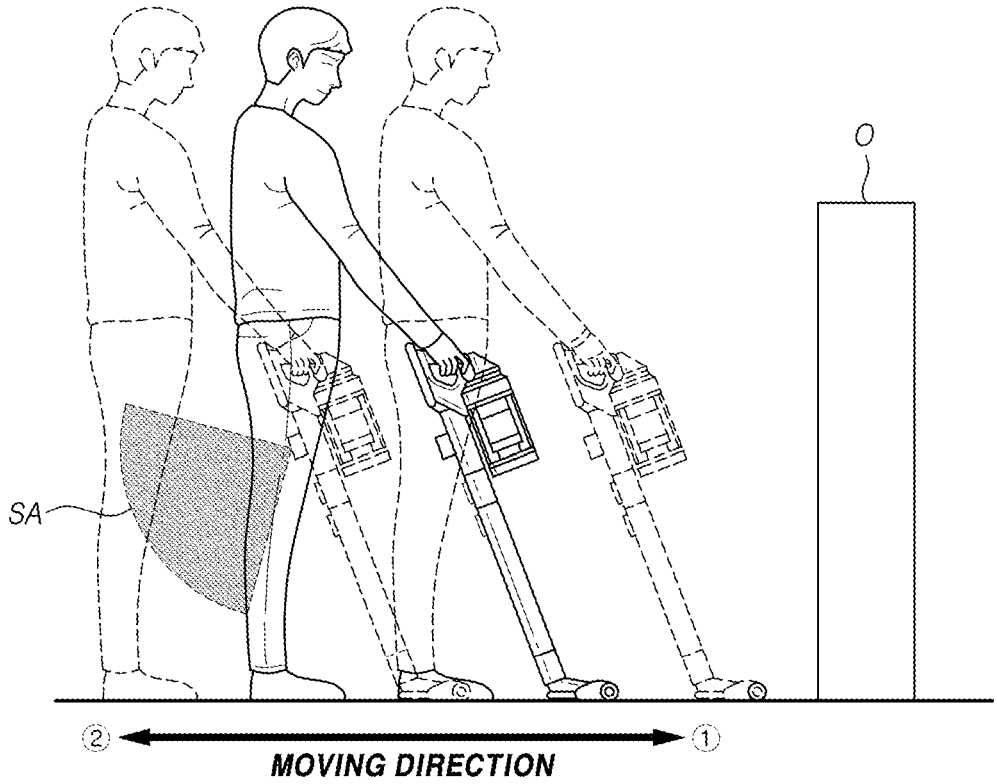
FIG. 18 is a view illustrating a situation that a user performs cleaning forward or backward with a vacuum cleaner according to an embodiment of the disclosure.

FIG. 17 is a perspective view of a vacuum cleaner with an obstacle detection sensor arranged at its rear side according to an embodiment of the disclosure. FIG. 18 is a view illustrating a situation that a user performs cleaning forward or backward with a vacuum cleaner according to an embodiment of the disclosure.

The vacuum cleaner 1*b* shown in FIG. 17 has a structure substantially the same as or similar to the vacuum cleaner 1*a* of FIG. 1, and differs only in the position where the obstacle detection sensor 60 is arranged. Hereinafter, for convenience of description, description will be made only of the portions that are different from the vacuum cleaner 1*a* of FIG. 1.

Referring to FIG. 17, according to an embodiment, the obstacle detection sensor 60 may be disposed to face the rear of the vacuum cleaner 1*b* (e.g., a user). The obstacle detection sensor 60 may be disposed in a rear side of at least one of the vacuum cleaner body 10, the suction assembly 20, or the connection pipe 30.

When the obstacle detection sensor 60 is disposed to face the rear (or the user) of at least one of the vacuum cleaner body 10, the suction assembly 20, or the connection pipe 30, the obstacle detection sensor 60 may be referred to as a rear detection sensor 60, and the signal area SA may be referred to as a rear signal area SA. According to an embodiment, the rear detection sensor 60 may transmit a rear signal S and detect the user by receiving a reflection signal RS reflected from the user located in the rear signal area SA by the rear signal S.

Referring to FIG. 18, the vacuum cleaner 1*b* may travel forward (in the direction ①) or backward (in the direction ②) by the user's manipulation.

According to an embodiment, when the user pushes the vacuum cleaner 1*b* forward (in the direction ①), the distance between the vacuum cleaner 1*b* and the user becomes farther away from each other, and the user may deviate from the signal area SA formed by the obstacle detection sensor 60. As the user moves the vacuum cleaner 1*b* forward, moving out of the signal area SA, the vacuum cleaner 1*b* may control to increase the rotation speed (e.g., RPM) of the suction motor 22*a* and/or the brush motor 44. For example, when the current cleaning mode is in a normal mode, the vacuum cleaner 1*b* may then change the cleaning mode to a power mode. Further, for example, when the current cleaning mode is in a power mode, the vacuum cleaner 1*b* may then change its cleaning mode to a superpower mode.

According to an embodiment, when the user pulls the vacuum cleaner 1*b* backward (in the direction ②), the distance between the vacuum cleaner 1*b* and the user becomes closer to each other, and the user may be detected in the signal area SA formed by the obstacle detection sensor 60. When the user is detected in the signal area SA as the user moves the vacuum cleaner 1*b* backward (in the direction ②), the vacuum cleaner 1*b* may control to reduce the rotation speed (e.g., RPM) of the suction motor 22*a* and/or the brush motor 44. The vacuum cleaner 1*b* may then change the cleaning mode to the power mode, for example, when the current cleaning mode is in the superpower mode. Further, the vacuum cleaner 1*b* may then change the cleaning mode to the normal mode, for example, when the current cleaning mode is a power mode.

As described above, referring to FIGS. 1, 2A, 2B, 3-5, 6A, 6B, 6C, 7-9, 10A, 10B, 11A, 11B, and 11 to 18, description has been mainly made of the embodiments in which the obstacle detection sensor 60 is arranged to face the front (see FIG. 1) or the rear (see FIG. 16), but the disclosure is not limited thereto. According to some embodiments, the vacuum cleaner 1 may include at least two or more obstacle detection sensors disposed to face forward and backward, respectively. For example, the vacuum cleaner 1 may detect an obstacle approaching the vacuum cleaner 1 through an obstacle detection sensor disposed in its front. Further, for example, the vacuum cleaner 1 may detect a user approaching the vacuum cleaner 1 through an obstacle detection sensor disposed at its rear. The control method of the vacuum cleaner 1 described above in FIG. 14 to 16 or 18 may also be applied in the same or similar manner.

Figure 19A:
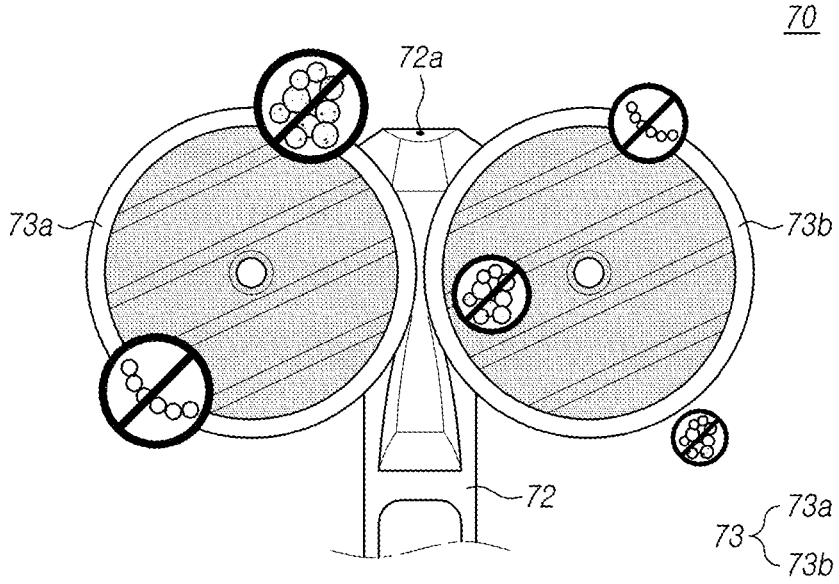
FIGS. 19A and 19B are views illustrating a damp floorcloth head of a vacuum cleaner according to an embodiment of the disclosure.
Figure 19B:
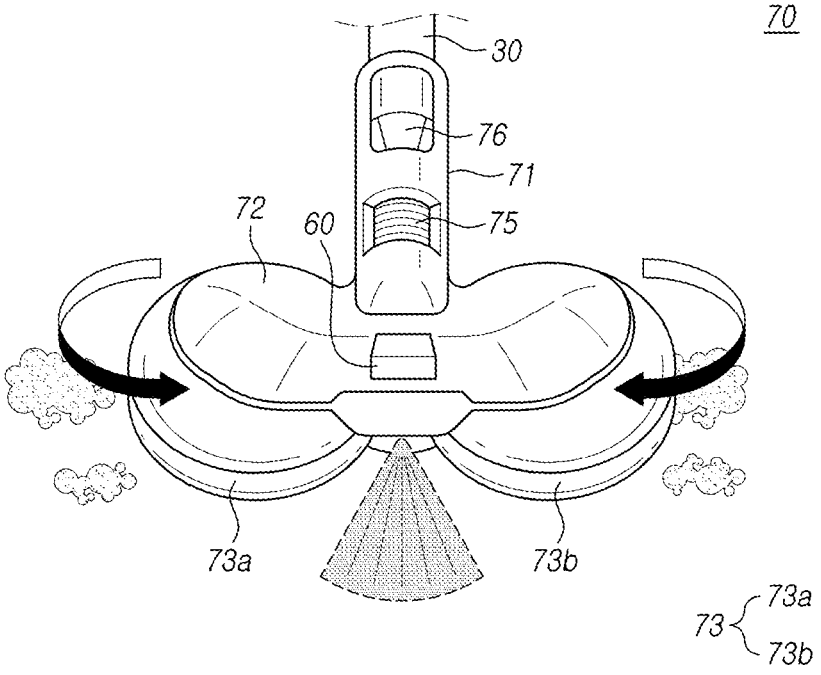

FIGS. 19A and 19B are views illustrating a damp floorcloth head of a vacuum cleaner according to an embodiment of the disclosure.

Referring to FIGS. 19A and 19B, according to an embodiment, the vacuum cleaner 1 may include a damp floorcloth head 70.

According to an embodiment, the damp floorcloth head 70 may come into contact with a bottom surface during a cleaning operation of the vacuum cleaner 1 to remove contaminants such as stains present on the bottom surface. The damp floorcloth head 70 may be configured to be rotatable in a vertical (up/down) direction or a horizontal (left/right) direction. The damp floorcloth head 70 may be coupled to the connection pipe 30. The damp floorcloth head 70 may be, for example, detachably coupled to the connection pipe 30.

The damp floorcloth head 70 may include a damp floorcloth head coupling 71, a pad casing 72, a pad 73, a pad motor 74, a damp floorcloth head joint 75, a water supply cylinder 76, or a water supply motor 77.

According to an embodiment, one end of the damp floorcloth head coupling 71 may be coupled to the connection pipe 30, and the other end thereof may be coupled to the pad casing 72. The damp floorcloth head coupling 71 may be, for example, detachably coupled to the connection pipe 30.

According to an embodiment, the pad casing 72 may form the overall appearance of the damp floorcloth head 70. The pad 73 and the pad motor 74 may be accommodated in the pad casing 72. According to an embodiment, a water injection port 72*a* for spraying water onto a bottom surface may be formed on one surface of the pad casing 72.

According to an embodiment, the pad 73 may be rotatably arranged on the pad casing 72. The pad 73 may be disposed parallel to the bottom surface. The damp floorcloth head 70 may remove foreign substances such as contaminants present on the bottom surface, according to rotation of the pad 73. The pad 73 may include, for example, a pair of damp floorcloths 73*a* and 73*b*.

According to an embodiment, the pad motor 74 may provide power to the pad 73 so that the pad 73 is rotatable. The pad motor 74 may be disposed inside the pad casing 72.

According to an embodiment, the damp floorcloth head joint 75 may be provided between the damp floorcloth head coupling 71 and the pad casing 72. The damp floorcloth head 70 may move rotatably up/down or left/right by the damp floorcloth head joint 75.

According to an embodiment, the water supply cylinder 76 may store water supplied to the pad casing 72 or the water injection port 72*a*. The water supply cylinder 76 may be, for example, detachably provided in the damp floorcloth head coupling 71.

According to an embodiment, the water supply motor 77 may be connected to the water supply cylinder 76 to supply water to the pad 73 or the water injection port 72*a* during a cleaning operation as required.

Figure 20:
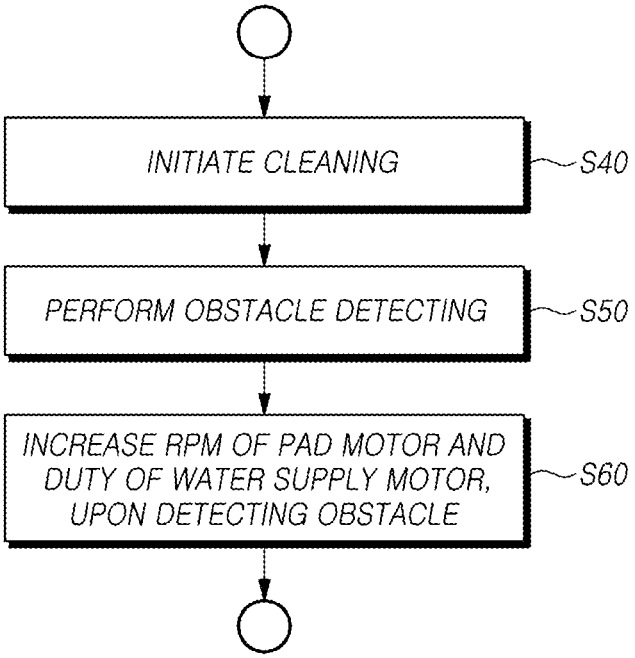
FIG. 20 is a flowchart illustrating a method of controlling a vacuum cleaner according to an embodiment of the disclosure.
Figure 21:
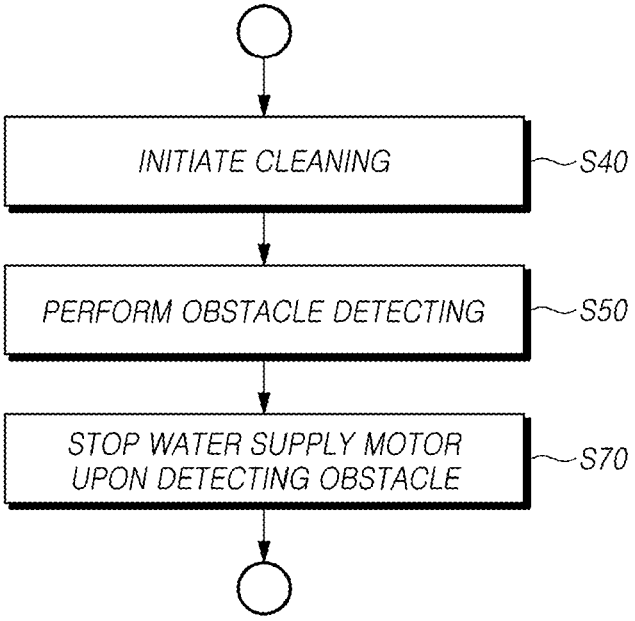
FIG. 21 is a flowchart illustrating a method of controlling a vacuum cleaner according to an embodiment of the disclosure.

FIG. 20 is a flowchart illustrating an example method of controlling a vacuum cleaner according to an embodiment of the disclosure. FIG. 21 is a flowchart illustrating an example method of controlling a vacuum cleaner according to an embodiment of the disclosure.

Referring back to FIG. 13, according to an embodiment, the controller 100 may control the operation of the pad motor 74 and/or the water supply motor 77 according to whether an obstacle is detected through the obstacle detection sensor 60.

Referring then to FIG. 20, according to an embodiment, the vacuum cleaner 1 may initiate and/or maintain a cleaning operation for removing foreign substances present on the floor surface, by the user's command and/or manipulation at operation S40. For example, the vacuum cleaner 1 may actuate the pad motor 74 and/or the water supply motor 77 according to the user's command and/or manipulation.

According to an embodiment, the vacuum cleaner 1 may perform the function of detecting an obstacle close approaching the vacuum cleaner 1 through the obstacle detection sensor 60 during a cleaning at operation S50.

According to an embodiment, when an obstacle is detected through the obstacle detection sensor 60, the vacuum cleaner 1 may increase the rotation speed (e.g., RPM) of the pad motor 74 at operation S60. For example, if no obstacle is detected, the vacuum cleaner 1 may control the rotation speed (e.g., RPM) of the pad motor 74 and/or the water supply motor 77 to the first rotation speed, and if an obstacle is detected, the vacuum cleaner 1 may control the rotation speed (e.g., RPM) of the pad motor 74 and/or the water supply motor 77 to the second rotation speed faster than the first rotation speed.

According to an embodiment, when an obstacle is detected through the obstacle detection sensor 60, the vacuum cleaner 1 may increase the duty of the water supply motor 77 to increase the amount of water supplied to the pad 73 at operation S60. For example, in case of the vacuum cleaner 1 having a structure in which water is supplied to the pad 73 of the damp floorcloth head 70, when an obstacle is detected, the vacuum cleaner 1 may increase the rotation speed (e.g., RPM) of the pad motor 74 and/or the duty of the water supply motor 77 so as to increase the cleaning capability of the vacuum cleaner 1.

Referring to FIG. 21, according to an embodiment, the vacuum cleaner 1 may initiate and/or maintain a cleaning operation for removing foreign substances present on the floor surface, with the user's command and/or manipulation at operation S40. For example, the vacuum cleaner 1 may actuate the pad motor 74 and/or the water supply motor 77 according to the user's command and/or manipulation.

According to an embodiment, the vacuum cleaner 1 may perform the function of detecting an obstacle close approaching the vacuum cleaner 1 through the obstacle detection sensor 60 during cleaning at operation S50.

According to an embodiment, when an obstacle is detected through the obstacle detection sensor 60, the vacuum cleaner 1 may cease the operation of the water supply motor 77 to stop spraying water through the water injection port 72*a* at operation S70. For example, in the case of a vacuum cleaner 1 having the structure to spray water onto the floor through the water injection port 72*a*, the vacuum cleaner 1 may cease the operation of the water supply motor 77 to prevent water from being sprayed onto the obstacle, once an obstacle is detected.

The terms used in the disclosure are used only to describe specific embodiments and are not intended to limit the disclosure thereto. For example, a component expressed in a singular form should be understood as a concept including multiple components unless the context explicitly dictates only such a singular form. As used herein, each of the phrases such as "A or B", "at least one of A and B", "at least one of A or B", "A, B or C", "at least one of A, B and C", and "at least one of A, B, or C" may include any one of the items enumerated together in a corresponding one of the phrases, or all possible combinations thereof. Further, it should be appreciated that the term 'and/or' used herein encompasses any and all possible combinations of one or more of the listed items. The terms such as "comprise(s)", "include(s)" "have/has", and "consist(s) of" used in the disclosure are only intended to designate that there are features, components, parts, or a combination thereof described in the disclosure, and are not intended to exclude a possibility of the presence or addition of one or more other features, components, parts, or a combination thereof, by using these terms. The terms such as "the first", "the second", or "first", or "second" may be used simply to distinguish a corresponding component from another corresponding component, and do not limit the corresponding components in view of other aspect (e.g., importance or order).

As used in the disclosure, the expression 'configured to~' may be used interchangeably with, depending on the context, for example, 'suitable for~', 'having the ability to~', 'designed to~', 'modified to~', 'made to~', 'capable of~' or the like. The term 'configured to~' may not necessarily mean only 'specially designed to~' in hardware. Instead, in some situations, the expression 'a device configured to ~' may mean that the device is 'capable of ~' together with another device or component. For example, a phrase 'a device configured to perform A, B, and C' may imply a dedicated device for performing a corresponding operation or imply a general-purpose device capable of performing various operations including the corresponding operation.

Meanwhile, the terms 'upper', 'lower', and 'forward/backward direction' used in the disclosure are defined based on the drawings, and the shape and the position of each component are not limited by these terms.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A vacuum cleaner comprising:

a main body; and a front detection sensor facing forward and disposed on a suction head coupled to one end of a connection pipe extending from the main body, wherein the front detection sensor is configured to:

transmit a forward signal, and receive a signal reflected from an obstacle located in a forward signal area by the forward signal so as to detect the obstacle, wherein the front detection sensor includes a transmitter configured to:

transmit a first forward signal for detecting obstacles located in a first signal area, and transmit a second forward signal for detecting obstacles located in a second signal area included in the first signal area, thereby diffusing the first forward signal and the second forward signal, wherein the second forward signal has a second amplitude and the first forward signal has a first amplitude greater than the second amplitude, and wherein the first forward signal forms a wider signal area than the second forward signal.

2. The vacuum cleaner of claim 1, wherein the transmitter includes:

a light emitter configured to transmit the first forward signal and the second forward signal; and a diffuser configured to diffuse the first forward signal and the second forward signal transmitted from the light emitter.

3. The vacuum cleaner of claim 2, wherein the diffuser includes a first lens having a predetermined refractive index.

4. The vacuum cleaner of claim 3, wherein a groove for inserting the light emitter is provided inside the first lens.

5. The vacuum cleaner of claim 2, wherein the diffuser includes a first reflection plate having a predetermined reflection angle.

6. The vacuum cleaner of claim 1, wherein the front detection sensor further includes at least one receiver including a lens configured to concentrate a signal reflected from the obstacle onto the at least one receiver.

7. The vacuum cleaner of claim 1, wherein the front detection sensor further includes at least one receiver including a reflection plate configured to concentrate a signal reflected from the obstacle onto the at least one receiver.

8. The vacuum cleaner of claim 1, wherein the front detection sensor further includes a first receiver and a second receiver, wherein the front detection sensor further includes a separation wall arranged to separate a signal incident on the first receiver from a signal incident on the second receiver, and wherein the separation wall is disposed between the first receiver and the second receiver.

9. The vacuum cleaner of claim 1, further comprising:

a controller configured to:

increase a rotation speed of a suction motor or a brush motor, based on the obstacle being detected in the forward signal area; and decrease the rotation speed of the suction motor or the brush motor, based on no obstacle being detected in the forward signal area.

10. The vacuum cleaner of claim 1, further comprising:

a controller configured to actuate a light or a vibrator, based on the obstacle being detected in the forward signal area.

11. The vacuum cleaner of claim 1, wherein the first forward signal and the second forward signal have different patterns between a leading signal and an ending signal.

12. The vacuum cleaner of claim 1, further comprising:

a controller configured to control a suction motor or a brush motor so that a rotation speed of the suction motor or the brush motor increases from a first rotation speed to a second rotation speed, based on the obstacle being detected in the first signal area.

13. The vacuum cleaner of claim 12, wherein the controller is further configured to control the suction motor or the brush motor so that the rotation speed of the suction motor or the brush motor increases from the second rotation speed to a third rotation speed, based on the obstacle being detected in the second signal area.

14. The vacuum cleaner of claim 1, further comprising:

a rear detection sensor facing backward in the connection pipe, wherein the rear detection sensor is configured to:

transmit a backward signal, and receive a signal reflected from a user located in a backward signal area by the backward signal so as to detect the user.

15. The vacuum cleaner of claim 14, further comprising:

a controller configured to control a rotation speed of a suction motor or a rotation speed of a brush motor, based on the signal reflected from the user.

16. The vacuum cleaner of claim 15, wherein the controller is further configured to control to:

decrease the rotation speed of the suction motor or the rotation speed of the brush motor, based on the signal reflected from the user being detected; and increase the rotation speed of the suction motor or the rotation speed of the brush motor, based on no signal reflected from the user being detected.

* * * * *